US005775180A

United States Patent [19]

Parke

[11] Patent Number: 5,775,180

[45] Date of Patent: Jul. 7, 1998

[54] SHARPENING DEVICE

[76] Inventor: Terrence J. Parke, Toolern Downs, Melton, Australia

[21] Appl. No.: 732,486

[22] PCT Filed: Apr. 28, 1995

[86] PCT No.: PCT/AU95/00245

§ 371 Date: Oct. 28, 1996

§ 102(e) Date: Oct. 28, 1996

[87] PCT Pub. No.: WO95/29789

PCT Pub. Date: Nov. 9, 1995

[30] Foreign Application Priority Data

Apr. 29, 1994 [AU] Australia ..... PM5340

[51] Int. Cl.[6] ..... B24B 3/36; B24B 3/46; B24B 3/52; B26D 7/12

[52] U.S. Cl. ..... 76/85; 451/404

[58] Field of Search ..... 76/85, 31, 82, 76/82.1, 86, 87, 89; 451/404, 374, 164, 48

[56] References Cited

U.S. PATENT DOCUMENTS

| | | | |
|---|---|---|---|
| 2,513,671 | 7/1950 | Perry | 76/31 |
| 2,801,554 | 8/1957 | Iveson | 76/31 |
| 2,885,911 | 5/1959 | Minici | 76/31 |
| 2,896,481 | 7/1959 | Hebbert . | |
| 3,881,888 | 5/1975 | Schwab . | |
| 3,900,970 | 8/1975 | Sollami . | |
| 4,040,313 | 8/1977 | Lustgraaf | 451/404 X |

FOREIGN PATENT DOCUMENTS

| | | |
|---|---|---|
| 69870/74 | 6/1974 | Australia . |
| 63135/94 | 12/1994 | Australia . |
| 225806 | 6/1987 | European Pat. Off. . |
| 2568156 | 1/1986 | France . |
| 2444965 | 4/1976 | Germany . |
| 173609 | 1/1922 | United Kingdom . |
| 507371 | 7/1939 | United Kingdom . |
| WO 84/03246 | 8/1984 | WIPO . |
| WO 89/12529 | 12/1989 | WIPO . |

*Primary Examiner*—Douglas D. Watts
*Attorney, Agent, or Firm*—Killworth, Gottman, Hagan & Schaeff L.L.P.

[57] ABSTRACT

A sharpening device (2) for sharpening the teeth (131) of a rotary blade (130) is described in which the device (2) comprises a substantially planar base (4) to which is pivotally attached a back plate (10) containing a number of components or subassemblies. One subassembly is for retaining rotary blades (130) in such a manner as to allow rotation of the blades (130) so that each tooth (131) of the blade (130) can be sharpened in turn. Another subassembly attached to back plate (10) is a guiding subassembly which is selectively angularly inclinable to the base (4) for being accurately located relative to a rotary blade (130) so that movement of a round file (75) linearly between rollers (74) attached to roller block (60) which in turn is angularly inclined to adjustment plate (34) effects sharpening of teeth (131).

34 Claims, 17 Drawing Sheets

104
10

130
142
150
152
71
72
145
74
62
47
72
64
90
86
182
180
184
36
38
34
52
54
84
82
80
70
74
140
146
10
23
22
8
6
16
4

104
10
150
152
130
72
74
62
47
70
74
72
60
90
182
180
184
36
54
84
86
80
82
142
140
146
145
52
10
8
23
22
16
6
4

17
102
15
130 131
107
75 74 60
151
150
230
162
210
232
160
182
172
202
224
180
34
10
27
184
198
222
15
200
23 36
214
21
16
24
6
8
7
4
7
5
17

SHARPENING DEVICE

The present invention relates generally to a sharpening apparatus, and in particular to a device for sharpening blades of a cutting implement or apparatus. Even more particularly, the present invention relates to an apparatus for sharpening rotary blades having a plurality of cutting teeth located around the circumference of the blade. The present invention finds particular application in sharpening the teeth of rotary blades for use in a rotary shearing handpiece, especially a rotary shearing bandpiece for shearing sheep, among other animals.

Although the present invention will be described with particular deference to a device or apparatus for sharpening the teeth of rotary blades of a rotary shearing handpiece for shearing sheep, it is to be noted that the present invention is not limited to the described embodiment or embodiments but rather the scope of the present invention is more extensive so as to include other arrangements of the device or apparatus and other applications of using the device or apparatus in whatever form it takes for whatever use.

One problem associated in general with cutting devices is being able to maintain the cutting edge or similar of the cutters or similar of the device or of components forming the device in a sharp condition for their effective or efficient use. Even after a small amount of use the cutting surfaces, edges, blades or the like of cutting implements become blunt which reduces their efficiency and may even cause damage to the material being cut. This is particularly so in the case of shearing wool from sheep where foreign material, such as for example, sand, dirt, grit or the like become entangled in the wool, particularly in dusty or dirty environments which causes wear on the cutting blades as the foreign material contacts the blades. Such problems usually occur in harsh conditions or environments which makes it even harder for the sheep and shearers. Even after a small amount of use the shears being used by the shearers to shear the sheep in the harsh or adverse environments are significantly blunted which reduces the efficiency of the handpiece which in turn results in a poorer cut to the wool and in extreme circumstances to damage to the sheep from cuts, nicks, scratches, abrasions and the like, which has the effect that the fleece is of less commerical value and the sheep require veterinary treatment.

When the blades of a handpiece become so blunt as to be unusable the shearer must then stop shearing and either replace the blades with sharp blades or sharpen the blades which results in the loss of productivity due to the downtime time it takes to replace or sharpen the blades during the working day or a reduction in the amount of free time available to the shearer if the blades are resharpened after hours. As shearers are usually paid in accordance with the number of sheep they shear per day, any time during the day during which the shearers are prevented from shearing which is lost erodes the available time for shearers to earn money. Such lost time reduces the income of the shearer and adds generally to the cost of the shearing exercise.

Another problem encountered in sharpening blades of shearing equipment is the amount of time and effort required to sharpen the blades, this is particularly so in the case of rotary blades having a plurality of teeth located around the circumference of the blade as each tooth must be individually sharpened and optionally reprofiled which requires that each tooth be accurately positioned before the set of each tooth is accurately cut or generally reset so that the blade can be sharpened. The positioning of the tooth prior to sharpening, resetting or reprofiling each individual tooth is laborious and time consuming.

Therefore, there is a need to provide a device or apparatus and method or process for sharpening blades of a cutting device, particularly a rotary blade having a number of cutting teeth, in a quick and efficient manner, which additionally allows more than a single blade to be sharpened at the one time and which permits the blade to be set so that all of the individual teeth can be quickly and easily sharpened from this single setting.

It is an aim of the present invention to provide a device or apparatus useful in quickly and efficiently sharpening the blades of a cutting device, particularly the rotary blades of a rotary handpiece for shearing sheep, and to a method and/or process of sharpening the blades using the apparatus.

According to the present invention there is provided a sharpening device for sharpening the cutting edge, surface or the like of a cutting element, said device comprising a means for holding the cutting element which means allows for movement of the cutting element of adopt a variety of positions enabling sharpening of the cutting element by movement of a sharpening means relative to the cutting element to sharpen the cutting element.

According to another aspect of the present invention there is provided a device for sharpening a cutting edge or similar of a cutting element, said device comprising a base member for supporting the device, a main member moveable with respect to the base member, said main member having a retaining subassembly for holding the cutting element, said subassembly being moveable with respect to the main member, and said main member having a guide subassembly which is moveable with respect to the main member, said guide subassembly having a guide member wherein said guide member is capable of cooperating with a sharpening means such that movement of the sharpening means with respect to the guide member sharpens the cutting element held by the retaining means, said device being arranged so that selective sharpening of the cutting element is in accordance with adjustment of the positions of the guide subassembly and retaining subassembly with respect to the main member and the position of the main member with respect to the base member.

According to another aspect of the present invention there is provided a device for sharpening a cutting edge or similar of a cutting element, said device comprising a base member for supporting the device in use, a main member pivotably moveable to the base member and extending substantially transversely from the base member, said main member being selectively adjustable with respect to the base member, said main member being provided with a guiding subassembly for guiding the movement of a sharpening means with respect to the cutting element, said guiding subassembly being pivotally moveable with respect to the main member and being arranged to extend substantially transversely with respect to the main member, said guiding subassembly comprising guide means for interacting with the cutting element and roller means for cooperating with the sharpening means by allowing movement of the sharpening means along a predetermined path with respect to the cutting element, and said main member being provided with a retaining subassembly for retaining the cutting element in a predetermined position with respect to the main member, said retaining subassembly being rotatable with respect to the main member to present different portions of the cutting edge of the cutting element to be sharpened wherein said guide means engages the cutting element to selectively adjust the position of the cutting element with respect to the guiding subassembly thereby allowing selective sharpening of the cutting edge or similar of a portion of the cutting element by movement of the sharpening means with respect to the cutting element, and then by rotation of the retaining subassembly a further portion of the cutting edge is presented for sharpening.

According to a further aspect of the present invention there is provided a device for sharpening a cutting edge or similar of a cutting element of a cutting machine, said device comprising a substantially rectilinear planar base plate to which a substantially planar main plate is pivotally connected to extend substantially transversely thereto and being able to adopt a selective position thereto, said base plate for supporting the device in use, said main plate being provided with an adjustment plate which is obliquely inclinedly moveable with respect to the main plate, said adjustment plate being selectively positionable with respect to the main plate, said adjustment plate being provided with a guiding subassembly comprising a substantially transversely moveable guide means and a pair of spaced apart roller wheels, said roller wheels being arranged for guiding the movement of a sharpening means and the guide means being provided for engaging a portion of the cutting element to selectively position the cutting element with respect to the sharpening means such that movement of the sharpening means selectively sharpens the portion of the cutting element contacted by the sharpening means, said main member being further provided with a holding subassembly extending transversely from the main plate and being rotatable thereto, said holding subassembly comprising a cutting element holding portion which upon rotation presents different portions of the cutting element in turn to the sharpening means for sharpening thereby.

The present invention will now be described by way of example with reference to the accompanying drawings in which.

Figure 1:
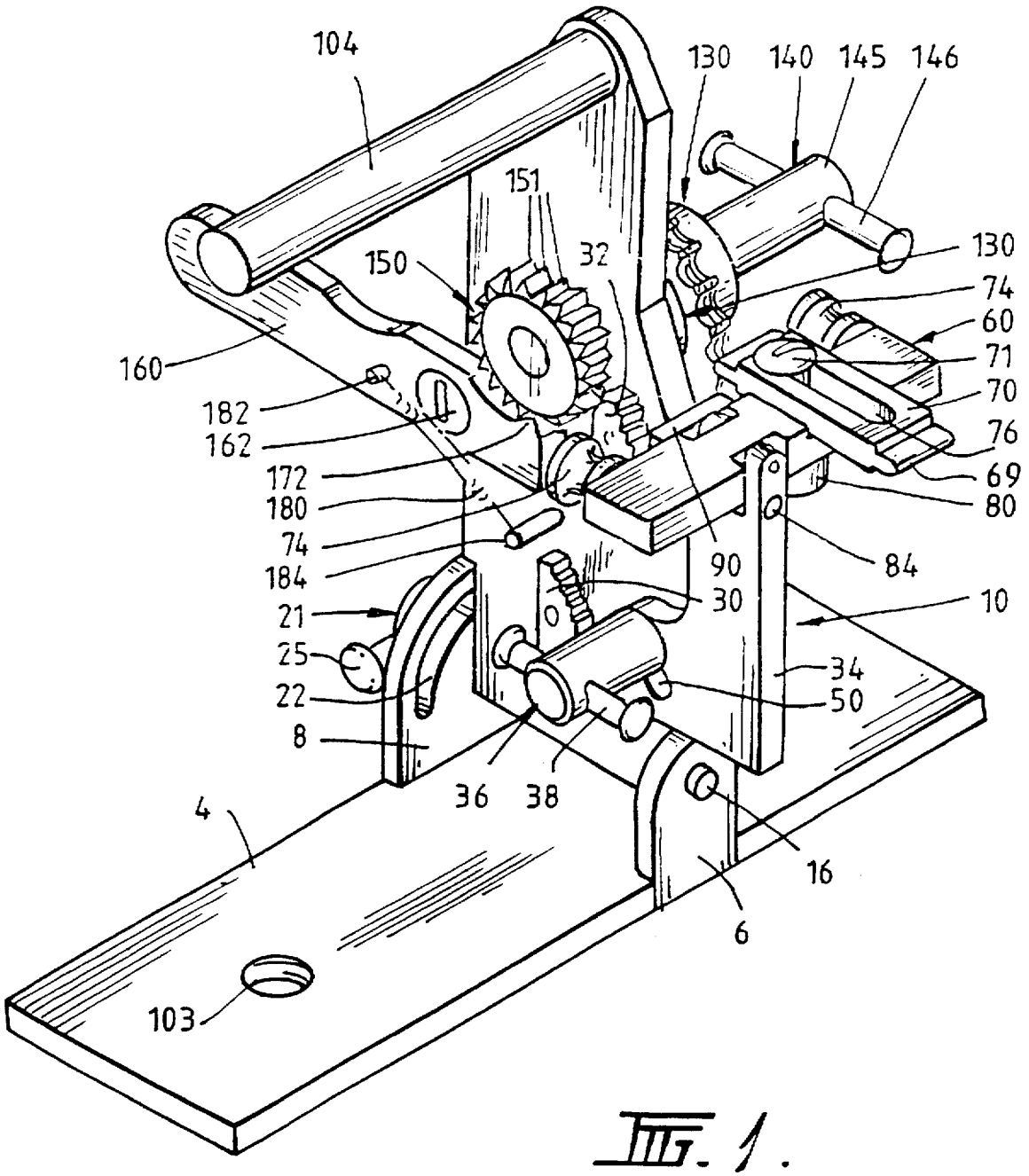
FIG. 1 is a front side top perspective view of one embodiment of the sharpening device made in accordance with the present invention.

One form of the device of the present invention will now be described with reference to FIGS. 1 to 9 and in particular with reference to FIG. 2 which shows the component parts of this form of the device. It is to be noted that the use of relative terms such as up, down, inboard, upper and the like in the present specification to described embodiments of the invention is with respect to the normal in use position of the device of the present invention, such as that shown in the drawings.

Figure 9:
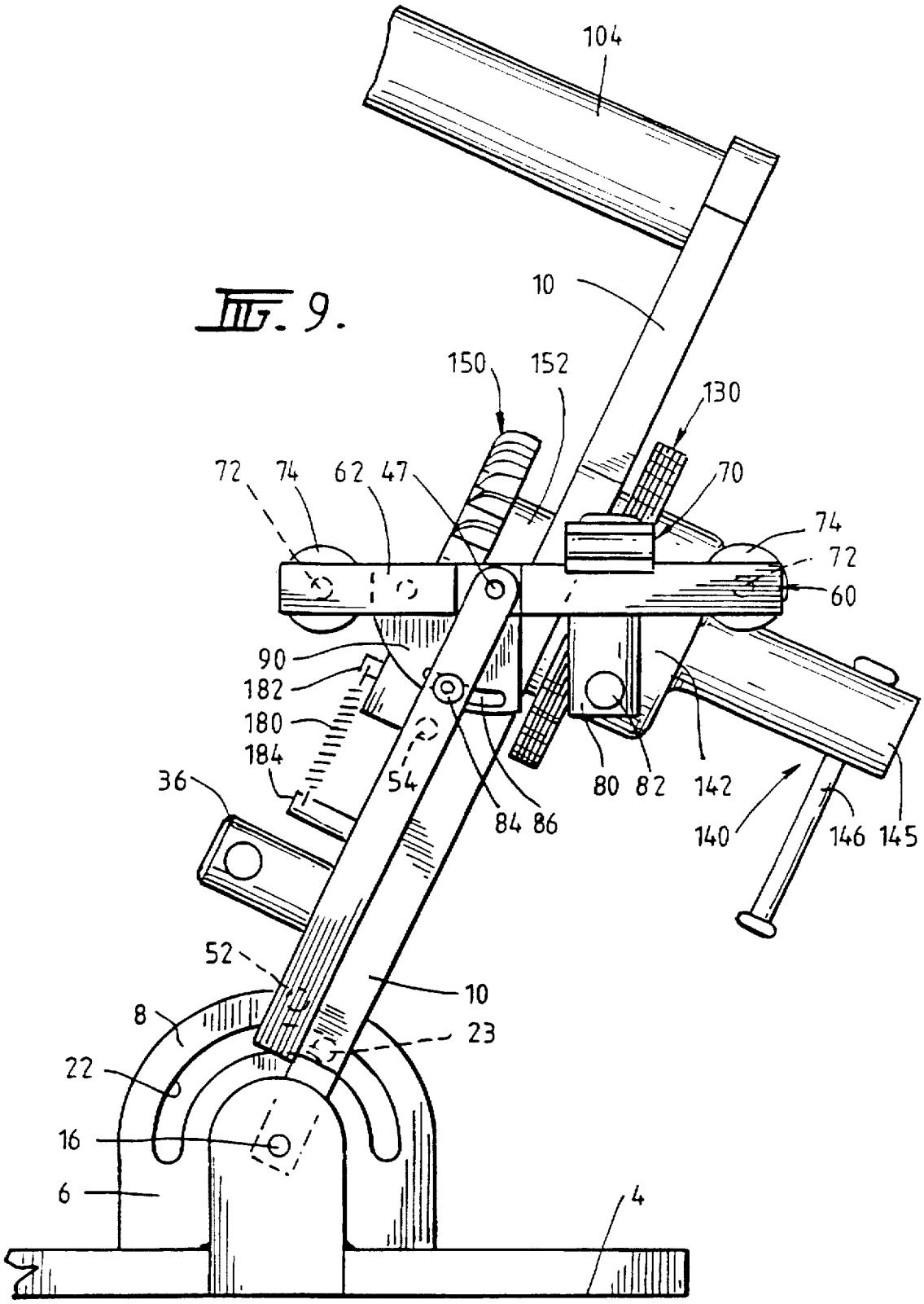
FIG. 9 is a side elevational view of the device of FIG. 1 shown in a further configuration.
Figure 10:
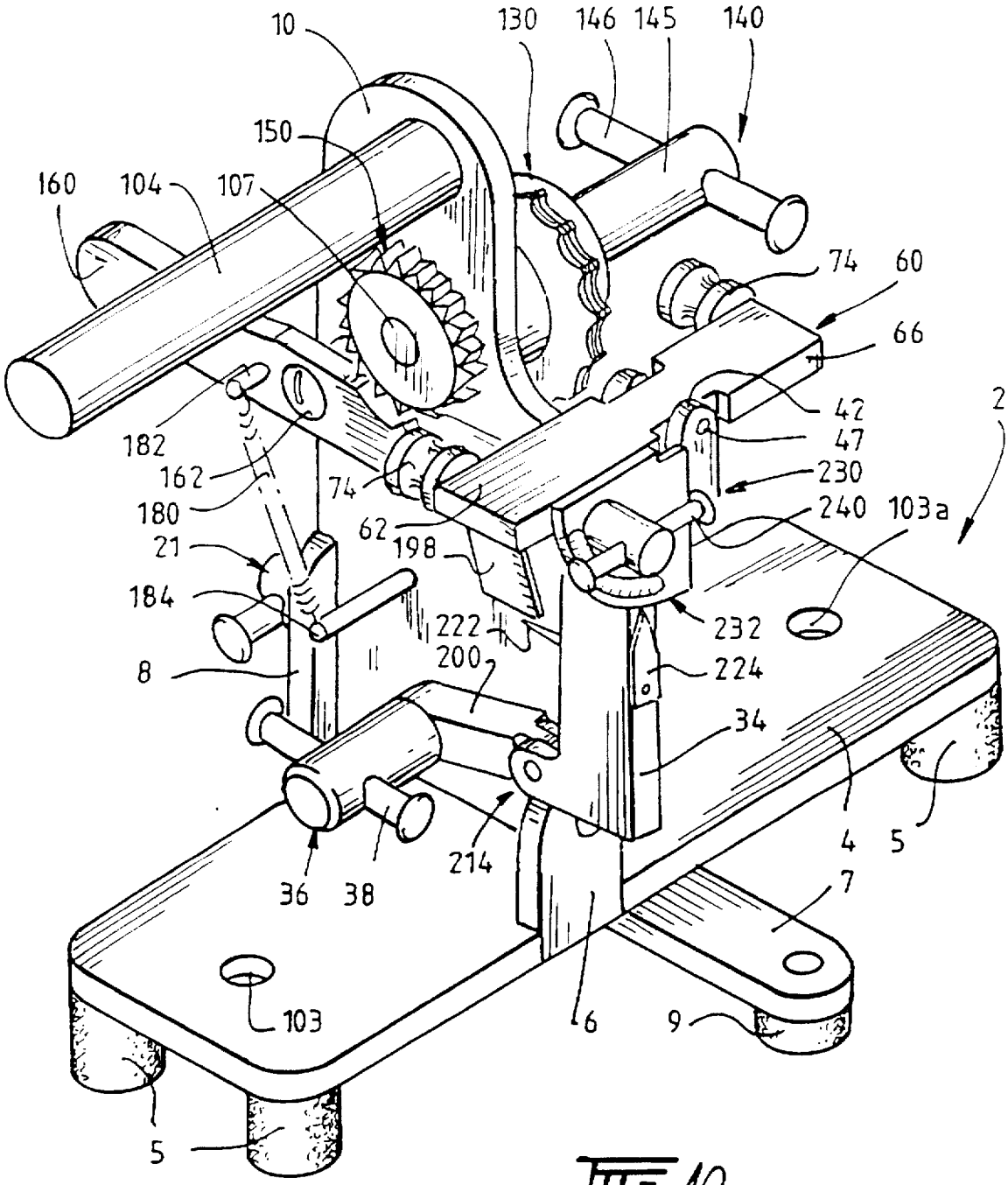
FIG. 10 is a front side top perspective view of another embodiment of the sharpening device made in accordance with the present invention.
Figure 11:
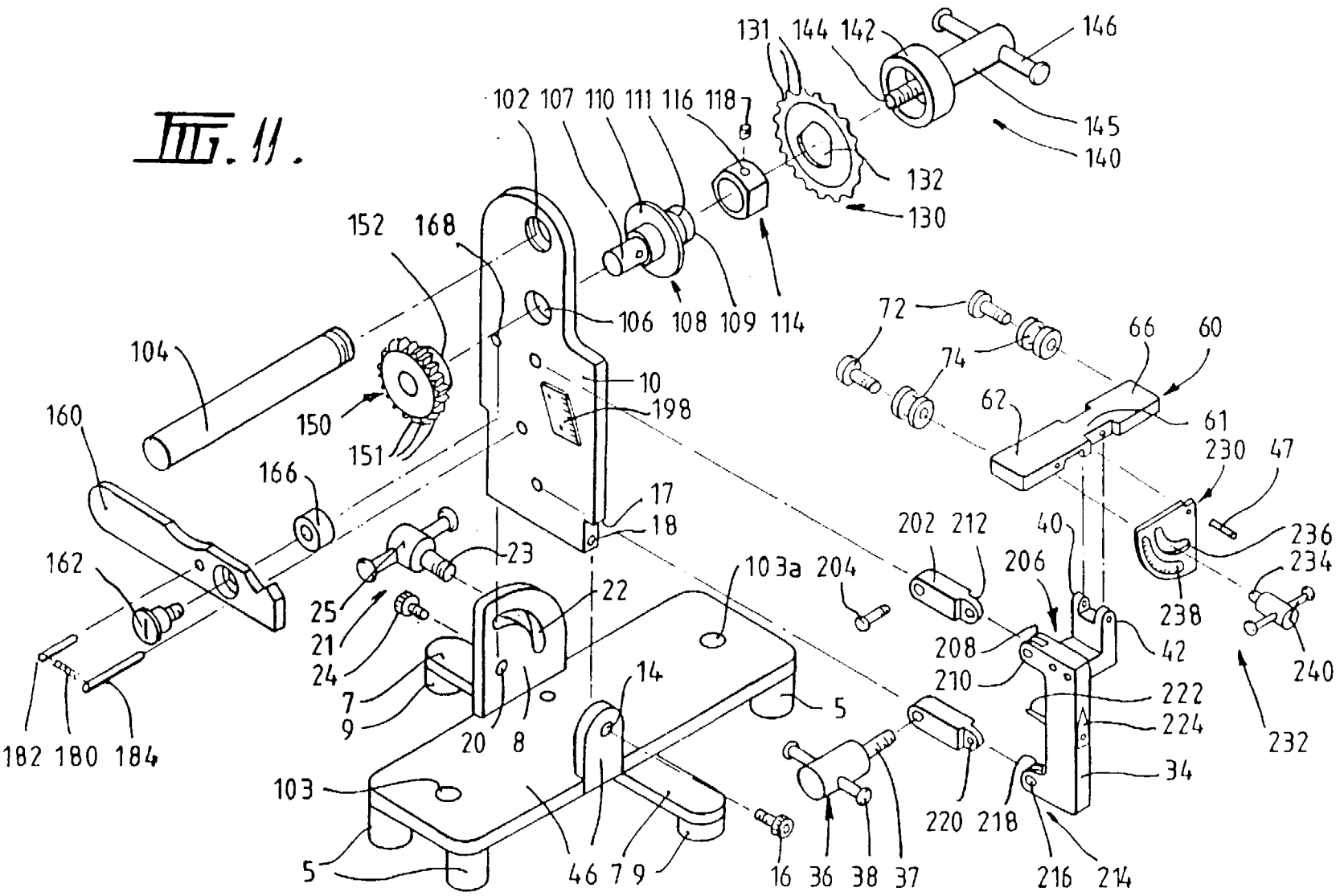
FIG. 11 is an exploded view of the device of FIG. 10.

In FIGS. 1 to 9 there is shown one form of the sharpening device of the present invention, generally denoted as 2. Device 2 in essence comprises a substantially planar rectilinear base plate 4 from which a pair of hinge brackets 6, 8 extend upwardly for mounting a substantially planar back plate 10 which is pivotally moveable with respect to the base plate 4 by virtue of being hinged thereto by hinge brackets 6, 8. With particular reference to FIG. 9 back plate 10 is free to adopt a number of different angularly inclinable positions relative to base plate 4 to assist in sharpening blades using the device 2 which will be described in more detail later. In one extreme position, back plate 10 can be folded flat against base plate 4 so that both are substantially parallel for transport and/or storage. It is to be noted that back plate 10 can pivot through 180° from being parallel to base plate 4 on one side to being parallel on the other side. More typically, back plate 10 can adopt any position with respect to base plate 4 between the 0° and 180° position, typically between about 40° and 140°, more typically between about 75° and 105°.

Figure 2:
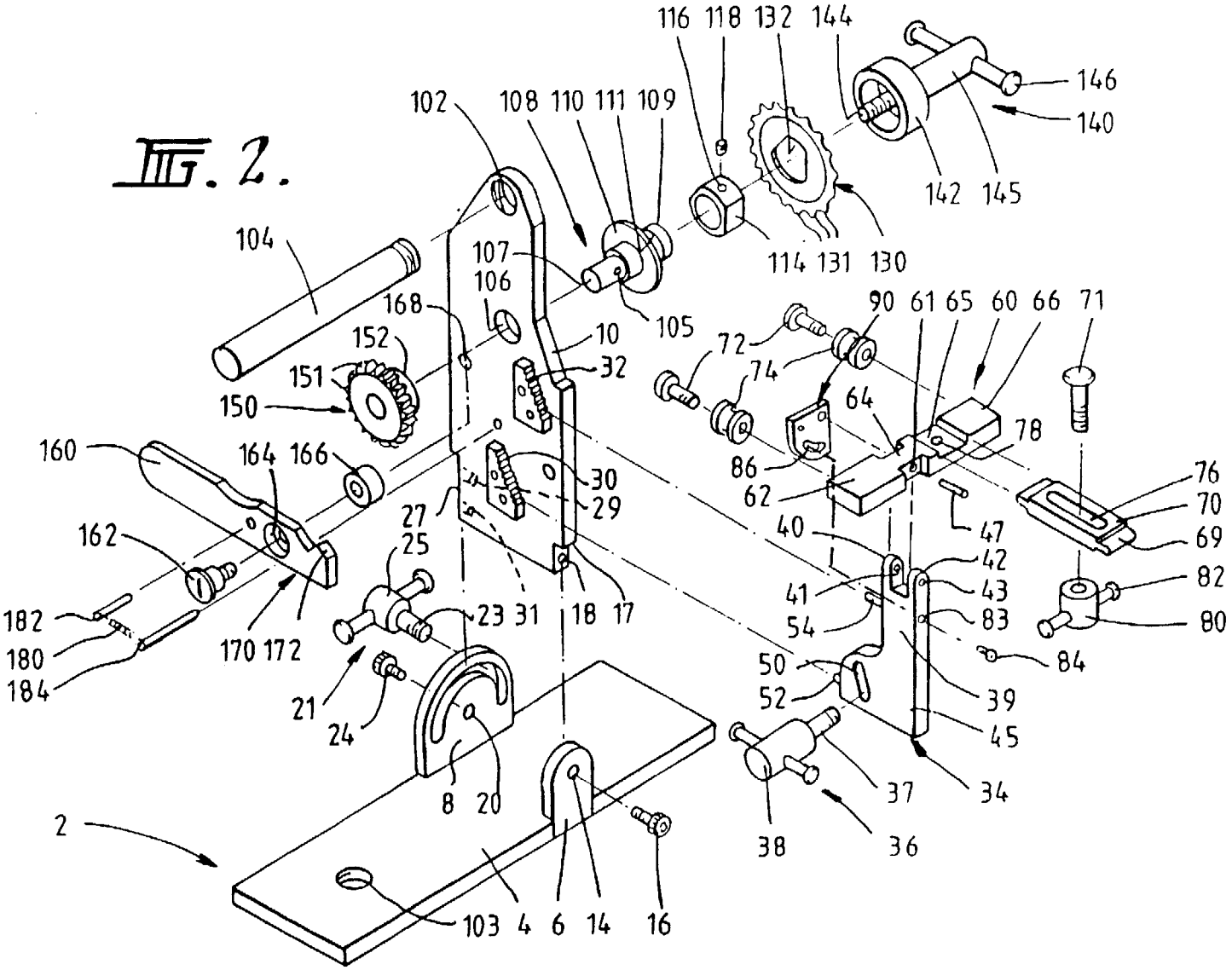
FIG. 2 is an exploded view of the device of FIG. 1.
Figure 3:
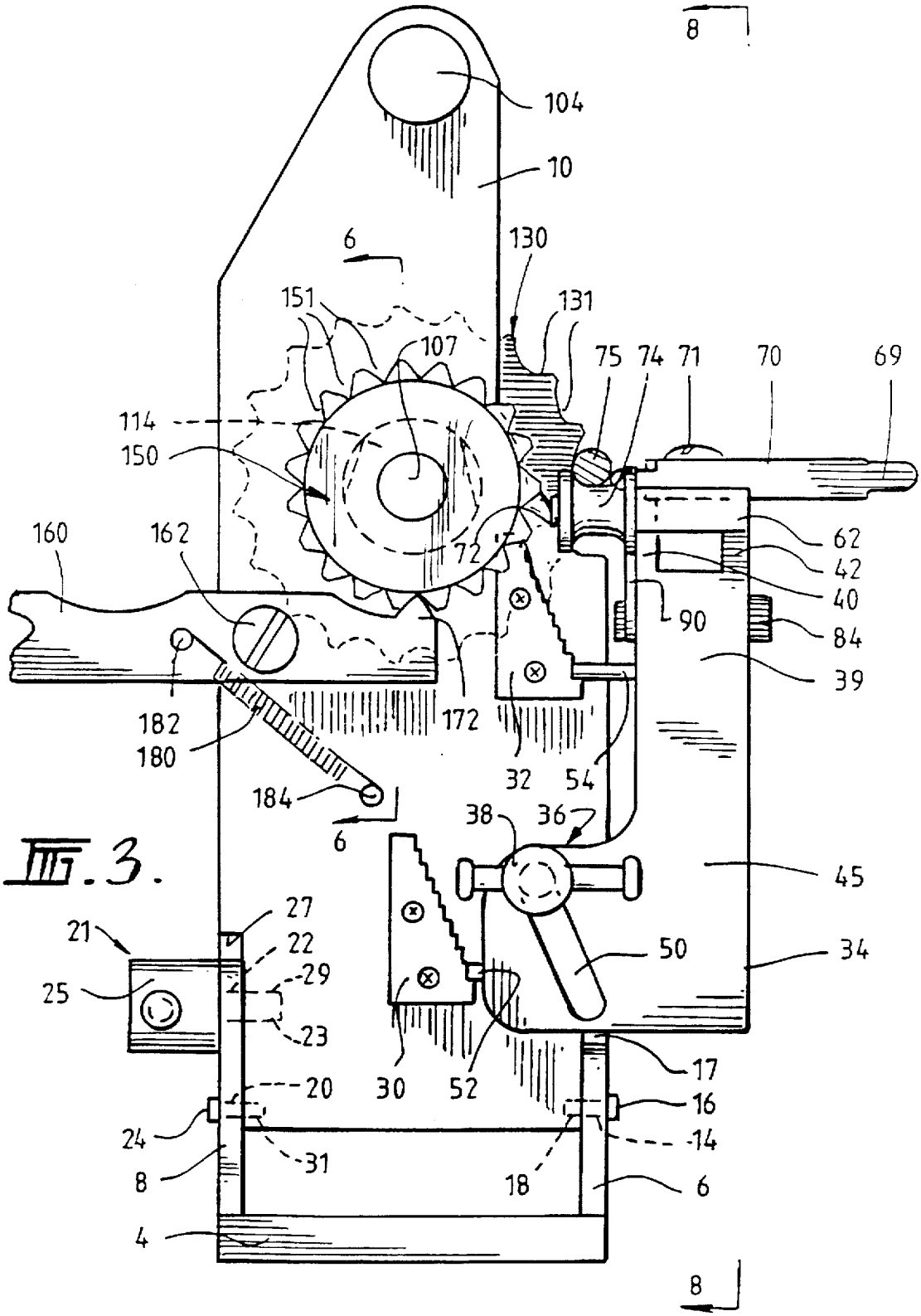
FIG. 3 is a front elevational view of the device of FIG. 1 in one configuration for sharpening a rotary blade.

With particular reference to FIG. 2 it can be seen that base plate 4 is substantially rectilinear and is provided on either longitudinal side with a pair of opposed cut outs located towards one end from the mid point. Hinge bracket 6, 8 are received in the pair of opposed cut outs. Hinge bracket 6 which is in essence a pivot hinge bracket is substantially elongate having a semi-circular end provided with an aperture 14 therethrough. A pivot pin 16 having a threaded end is received through aperture 14 and is secured to back plate 10 by being received in a correspondingly threaded bore 18 provided in the rebate 17 at one lower corner in use of back plate 10. Bore 18 and rebate 17 are located in the side edge of plate 10.

Hinge bracket 8 functions as both a hinge and a lock and is therefore a locking hinge bracket. Bracket 8 is substantially wider than hinge bracket 6 and is substantially longer than hinge bracket 6 as well as being provided with an aperture 20 for pivoting main plate 10 with respect to base plate 4 and a substantially semi-circular groove or slot 22 permitting adjustment of the position of back plate 10 with respect to base plate 4. A pivot pin 24 having a threaded end is received through aperture 20 and is threadingly engaged within threaded bore 31 provided in rebate 27 at the opposed lower in use corner from rebate 17 of back plate 10. An adjustment means in the form of a winged nut or lock screw 21 having an axial shaft 23 and a transverse handle 25 in the form of a dowel, rod or similar to facilitate rotation of lock screw 21 is arranged so that axial shaft 22 is received through semi-circular slot 22 into a further threaded bore 29 of back plate 10 spaced apart from threaded bore 31. Lock screw 21 can be loosened to allow for pivotal movement of back plate 10 with respect to base plate 4 in order to adjust the configuration or orientation of the device 2. When device 2 is in the desired or selected position lock screw 21 can be tightened to maintain the position of back plate 10 with respect to base plate 4. The position of back plate 10 can be altered with respect to base plate 4 from extending substantially perpendicularly therefrom in one extreme position to lie almost parallel in another extreme position or to any position in between. In the almost parallel position, device 2 can be transported and/or stored.

Back plate 10 carries a number of separate subassemblies as well as separate components. One of the components attached to back plate 10 is a pair of stepped blocks 30, 32 which are securely attached to back plate 10 at both vertically and horizontally spaced apart locations to each other. Each block 30, 32 is securely attached to back plate 10 by suitable means such as for example by counter sunk Phillips head screws being threadingly received in corresponding bores in main plate 10. Each stepped block 30, 32 is provided with two orthogonal rectilinear sides or edges and a third stepped side joining the other two straight edges. The stepped side of each block allows both vertical and horizontal adjustment for sharpening teeth of a rotary blade which will be described in more detail later.

Adjustment plate 34 is connected to back plate 10 by means of a threaded lock screw 36 having an axial shaft 37 and a handle 38 in the form of a transverse tommy bar or similar. Adjustment plate 34 is provided at its upper end in use with a yoke arrangement defined by a pair of spaced apart upwardly extending arms 40, 42. Each arm has a rounded free end and is provided with an aperture 41, 43 respectively therethrough. The two apertures 41, 43 are in register with each other. Adjustment plate 34 is provided with an in use upper body portion 39 of a relatively narrow width and an in use lower body portion 45 of wider width. The narrow body portion 37 merges curvedly to the wider body portion 45 along the inboard facing side of adjustment plate 34 whereas the other side of adjustment plate 34 is straight. The wider body portion 45 is provided with an obliquely inclined adjustment slot 46 which is inclined in a direction towards the centre of the device 2 and in an upwards direction. Lock screw 36 is received through obliquely inclined adjustment slot 50 and is fastened to back plate 10. A first pin 52 extends transversely from the inboard facing edge of the wider body portion 45 of plate 34 for engagement with one of the steps of the stepped side of stepped block 30. A second pin 54 substantially vertically spaced apart from pin 52 extends transversely from the inboard facing edge of the narrow body portion 39 of adjustment plate 34 to engage with the stepped side of stepped block 32. In use when lock screw 36 is loosened from back plate 10 adjustment plate 34 can be moved vertically and horizontally by means of inclined slot 50 so that pins 52, 54 engage with selected respective steps of blocks 30, 32 to adjust the position of plate 34. When the adjustment plate 34 is in the selected position lock screw 36 is tightened to back plate 10 in order to retain adjustment plate 34 securely in position.

Roller block 60 is pivotally connected to the upper end in use of adjustment plate 34 and is received in the yoke defined between arms 40, 42 of adjustment plate 34. Pin 47 is received through the aligned apertures 41, 43 provided in the ends of arms 40, 42 and through a bore 61 provided in the body of roller block 60 about its mid point. Roller block 60 has a head portion 62 located at one end and a body portion 66 located at the other end with a neck portion 64 located intermediate the head portion 62 and the body portion 66. Body portion 66 is provided with a rebate 65 or cut out for receiving a guide 70. Rebate 65 is located towards the neck portion 64 in roller block 60. Body portion 66 and head portion 62 of roller block 60 are each provided with a threaded bore for receiving the threaded ends of threaded pins 72 which form axles for rotating guide rollers 74 allowing guide rollers 74 to freely rotate about pins 72. Guide rollers 74 are each in the form of a double ended flange having a recessed central portion between the flanges in which the wall of the central portion between the flanges is substantially concavely curved. The shape or profile of the central portion of roller 74 is adapted to receive a circular file 75 for sharpening the teeth of rotary blades mounted on the device which will be described in more detail later.

Guide 70 is attached to roller block 60 by having a threaded pin 71 received through an elongate slot 76 extending longitudinally along the lengthwise extending direction of guide 70 and through aperture 78 provided in rebate 65 of the body portion 66 of roller block 60 and being received in threaded nut 80 having an internally threaded bore and a pair of opposed wings or similar such as for example a transverse dowel to effect rotation of the nut 80.

Adjustment plate 34 is provided with a transverse bore 83 vertically spaced apart from and in close proximity to transversely extending pin 54. Lock screw 84 is received through bore 83 and extends through the entire width of the narrow portion 39 of adjustment plate 34 to extend outwardly. Lock screw 84 is then received through a partly circular slot 86 provided in swivel plate 90.

Swivel plate 90 is fixedly attached to roller block 60 at two spaced apart locations on the inboard facing edge of roller block 60 between the neck portion 64 and head portion 66. The first location is by means of pivot pin 47 which is received through apertures 41, 43 of arms 40, 42 of adjustment plate 34 and bore 61 of neck portion 64 of roller block 60 whereas the second location is in head portion 62 of roller block 60. Swivel plate 90 when lock screw 84 is loosened allows roller block 60 to pivot about pin 47 with respect to adjustment plate 34. Thus roller block 60 is pivotally adjustable about a horizontal axis with respect to adjustment plate 34. Lock screw 84 is tightened to maintain roller block 60 in the desired position with respect to adjustment plate 34.

Returning to back plate 10, it can be seen that back plate 10 is provided with a threaded aperture 102 at the extreme upper end in use. Threaded rod 104 is threadingly received in aperture 102 to act as a carrying handle for device 2 when not in use. A similar threaded aperture 103 is provided in base plate 4 for receiving the end of threaded rod 104 so that rod 104 may be used as securely hold device 2 in place when device 2 is in use such as by rod 104 being received in a suitable holding means such as for example a vice a similar or being received in a bore of a stand or similar. In this configuration rod 104 extends downwardly in the opposite direction to the direction of extension of main plate 10. A second aperture 106 is provided at a location vertically spaced apart and below from aperture 102 for receiving a blade retaining subassembly for allowing individual blades being sharpened to be rotated in turn. The sub-assembly comprises blade spindle 108 comprises a shaft having a reduced diameter shank portion 107 at one end for being received diameter shank portion 107 at one end for being received through aperture 106 and 107 at one end for being received through aperture 106 and an internally threaded hollow portion 109 at the other end of a greater diameter than that of reduced diameter portion 107. Ratchet wheel 150 (to be described later) is received on portion 107 on the other side of main plate 10 as portion 107 extends through the beyond main plate 10.

A flange 110 is provided around and connected to the outside diameter of hollow portion 109. Flange 110 in use abuts against the side of main plate 10 opposite to that of ratchet wheel 150. Hollow portion 109 is provided with a circumferential groove 111 around the external circumference for receiving a suitable fastening means of a blade locating hub or collar 114.

Blade locating hub 114 is in the form of a substantially annular collar having an internal cylindrical bore and an outer profile in the form of a substantially irregular pentagon. In one embodiment blade locating hub 114 is provided with an aperture 116 in the side wall extending through the thickness of the side wall of collar 114 for receiving a grub screw 118 or similar which engages in groove 111 provided externally around the outside of portion 109 of blade spindle 108. The cylindrical bore of collar 114 is received over the outer circumference of hollow portion 109.

Rotary blade 130 having a plurality of cutting teeth 131 located at regularly spaced apart locations around the circumference of the blade is provided with a substantially irregular pentagonal eccentric cut out 132 of corresponding shape to the eccentric shape of the outer surface of blade locating hub 114 so that blade 130 may be placed over blade locating hub 114 in a single orientation only so as to hold blade 130 in the correct orientation when being sharpened.

An adjustable blade locking cap 140 is provided at one end with an annular cap portion 142 surrounding a centrally located threaded shaft 144 which extends longitudinally outwardly from the end of annular cap portion 142 and a main shaft 145 axially in alignment with threaded shaft 144. Main shaft 145 is provided with a tommy bar 146 or similar to facilitate rotation of the blade locking cap and in turn of rotary blade 130 so that each tooth of blade 130 may be sharpened in turn. Threaded portion 144 of blade locking cap 140 is received through the cylindrical bore or blade locating hub 114 and is threadingly received in the internally threaded bore of portion 109 of blade spindle 108. When end cap 140 is securely fastened to spindle 108 rotary blade 130 is securely held in place so that the teeth 131 can be sharpened.

Returning now to the other end of the sub-assembly containing the blade locating hub 108 it can be seen that ratchet-wheel 150 is received on the free end of reduced diameter shank portion 107 when it extends through aperture 106. Ratchet wheel 150 is provided with a spacer collar or boss 152 which in turn is provided with an axial bore and a radial aperture through which a suitable fastener can be received to attach ratchet wheel 150 to shank portion 107. Reduced diameter shank portion 107 is also provided with a radial aperture or bore 105. The suitable fastener is received through the radial aperture 105 when aligned with the radial bore of boss 152 to attach ratchet wheel 150 to blade spindle 108.

Release handle 160 is pivotally connected to back plate 10 by means of handle pin 162 being received through aperture 164 of handle 160 through spacer 166 located between handle 160 and back plate 10 and being received in threaded aperture 168 of back plate 10 at a position which is obliquely inclined to the position of aperture 106 on back plate 10. Release handle 160 is provided with a pawl arrangement 170 located at or towards one end thereof. Pawl arrangement 170 comprises a tooth 172 of complimentary shape to the grooves between adjacent teeth of ratchet wheel 150 so that pawl tooth 172 can engage with ratchet wheel 150. When pawl 170 is in engagement with ratchet wheel 150, ratchet wheel 150 is prevented from rotation which in turn prevents blade 130 from turning. When release handle 160 is moved to disengage pawl 170 from ratchet wheel 150, ratchet wheel 150 is free to rotate so that by an operator turning dowel 146 the whole sub-assembly containing blade 130 may be turned. Alternatively, the teeth of the ratchet wheel 150 may be so shaped to allow ratchet wheel 150 to be turned in one direction only and be retained in place or the tooth 172 of pawl 170 is so shaped to allow rotation of wheel 150 in one direction only and prevent rotation in the other direction.

An engagement bias is applied to release handle 160 by means of extension spring 180 extending between pin 182 securely attached to handle 160 and pin 184 securely attached to back plate pin.

In use of the device 2 of the present invention, base plate 4 is located on a suitable supporting substrate, such as for example, on a bench, stand or similar. Typically, device 2 may be permanently mounted on a bench or suitable stand such as by releasable fasteners or screws or the like, or handle 104 may be removed from aperture 102 and threadingly inserted in a suitable threaded aperture 103 provided in the base plate 4 to extend downwardly. Handle 104 may then be clamped or otherwise fastened to a suitable solid support, such as in a vice or similar.

Once device 2 is securely held in place, lock screw 21 is loosened and the position of back plate 10 is adjusted with respect to base plate 4. Once back plate 10 is in the correct position lock screw 21 is tightened so as to securely maintain back plate 10 in the correct position.

End cap 140 is then removed from blade spindle 108 by being rotated which threadingly disengages threaded shaft 144 from the threaded bore of hollow portion 109. One or more blades 130 are then placed upon blade locating hub 114 by irregular pentagonal cut out 132 being received over complementary shaped blade locating hub 114.

In the case of the embodiment of FIGS. 1 to 9, each of the blades 130 received on blade locating hub 114 is approximately aligned and then correctly oriented by one gullet between adjacent teeth of each blade being located between one end of guide 70. Then blade locking cap 140 is partially tightened by being rotated so that shaft 144 is received in hollow portion 109.

Threaded nut 80 is then loosened and the appropriate shaped end 69 of guide 70 is moved against blades 130 so that the end 69 of guide 70 is received in the collected gullets between adjacent teeth 131 of blades 130. When all of the blades are correctly aligned with each other end cap 140 is fully tightened to hold the blades in position. After this, nut 80 is loosened and guide 70 withdrawn so that guide end 69 is withdrawn from the gullets of the teeth of the blades 130.

Then, lock screw 36 is loosened which allows adjustment plate 34 to move about inclined slot 50 and positioned at the correct height so that pins 53, 54 engage the selected steps of respective stepped blocks 30, 32. When adjustment plate is in the correct position, lock screw 36 is tightened to maintain the position of adjustment plate 34.

Finally, lock screw 84 is loosened which allows roller block 60 to be pivoted to adopt the desired position. Roller block 60 is pivotable by the action of swivel plate 90 moving with roller block 60 wherein the shaft of lock screw 84 is received in arcuate slot 86. When roller block 60 is in the correct position, lock screw 84 is tightened. In one preferred position, roller block 60 is adjusted to lie in the same plane as base plate 4 i.e. both roller block 60 and base plate 4 are in the same substantially parallel relationship or nearly so.

Now that device 2 is fully adjusted, circular file 75 is placed upon rollers 74 so that the body of the file is received in the curve sided central portion of each roller. When in this position the outer surface of file 75 contacts the cutting surface of the tooth of each blade 130 located nearby. Axial movement of file 75 backwards and forwards allows each set of teeth of the collection of blades to be sharpened.

When the first set of teeth are sharpened, release handle 160 is moved against the spring bias of spring 180 so that pawl 172 disengages from ratchet wheel 150 thus allowing ratchet wheel 150 to turn. By rotating end cap 140, the next step of adjacent teeth of blades 130 is positioned ready to be sharpened and release handle 160 is then released which allows pawl 172 to engage with ratchet wheel 150. The next set of teeth are sharpened and so on until all of the teeth of all of the blades are sharpened. Alternatively, end cap 140 may be rotated against the bias of spring 180 holding pawl 172 of ratchet wheel 150 by having the teeth of ratchet wheel 150 so shaped to allow ratchet wheel 150 to slide past pawl 172, and click into place against the next tooth of ratchet wheel 150.

The described arrangement has been advanced by explanation and many modifications may be made without departing from the spirit and scope of the invention which includes every novel feature and novel combination of features hereindisclosed.

Figure 4:
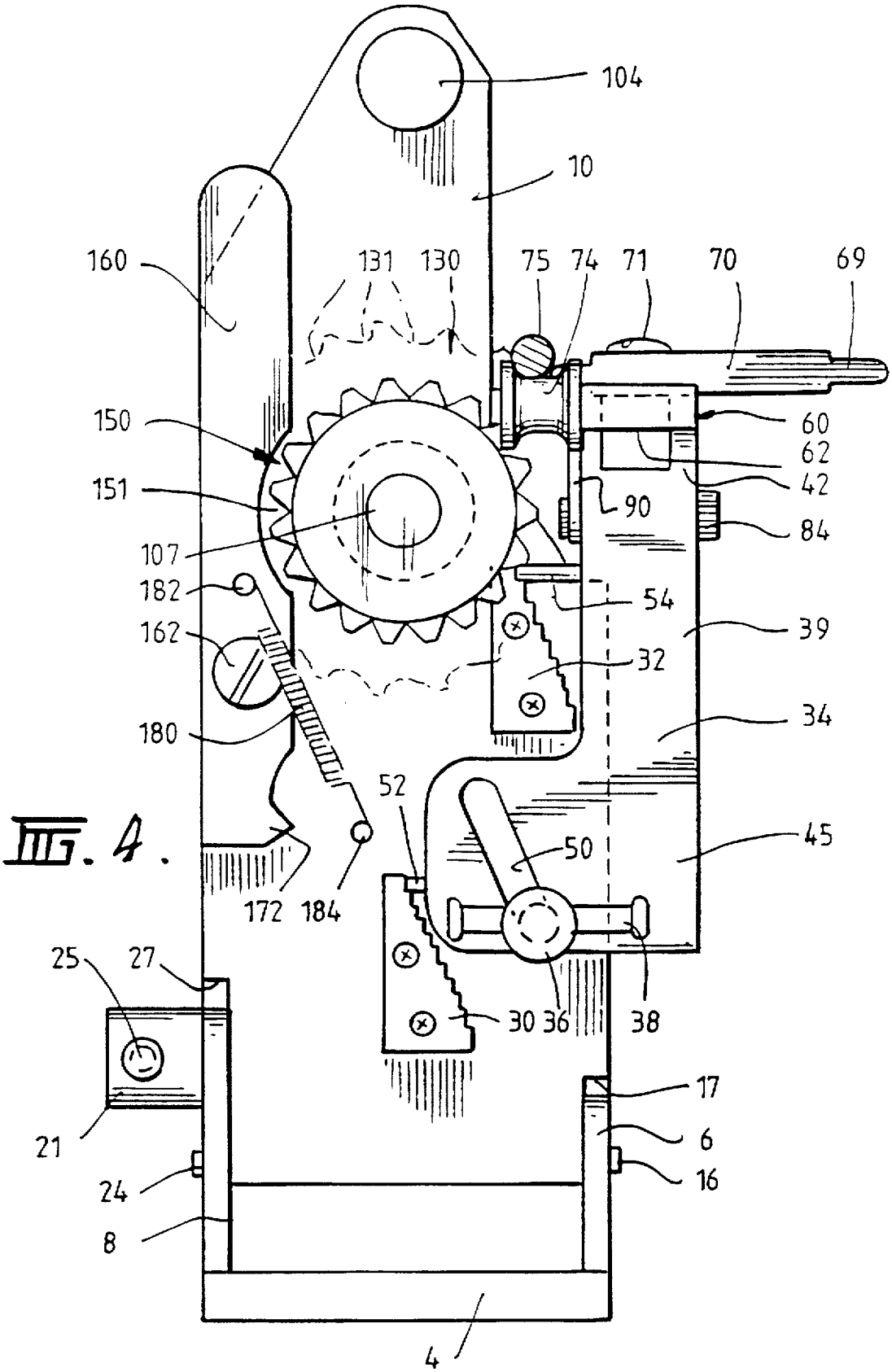
FIG. 4 is a view similar to that of FIG. 3 but in which the device adopts a different position.
Figure 5:
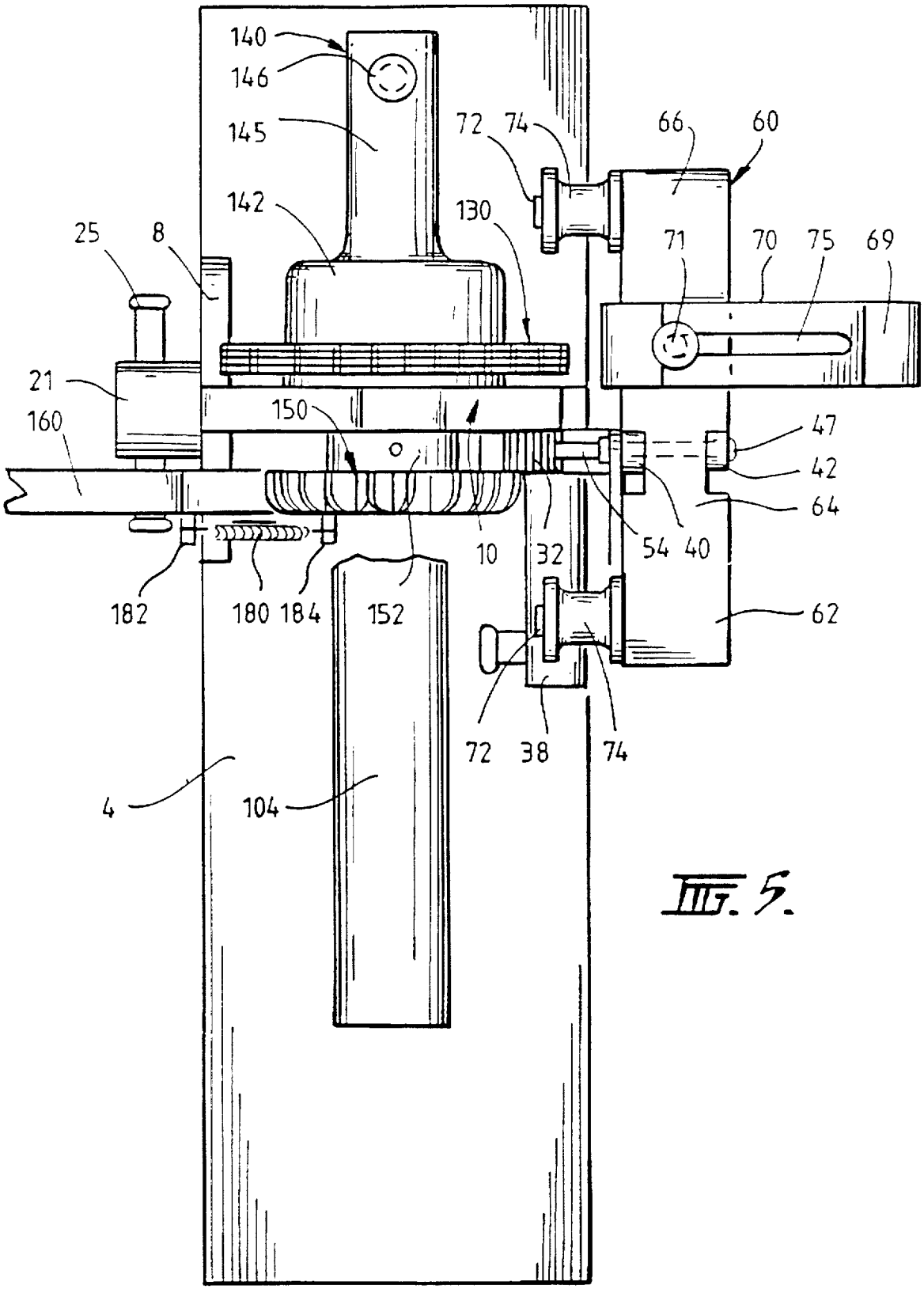
FIG. 5 is a top plan view of the device of FIG. 1.
Figure 6:
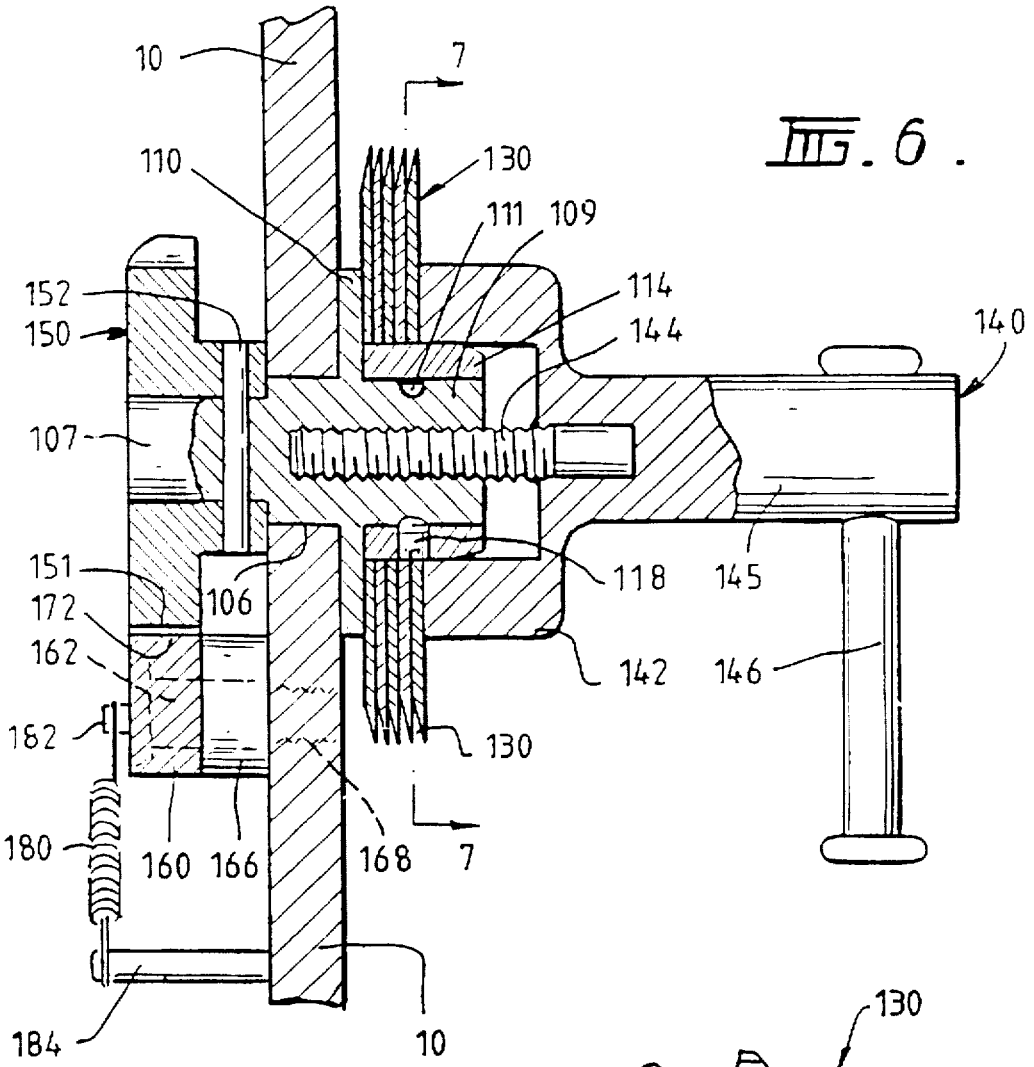
FIG. 6 is a longitudinal cross-sectional view along the line 6—6 of FIG. 3.
Figure 7:
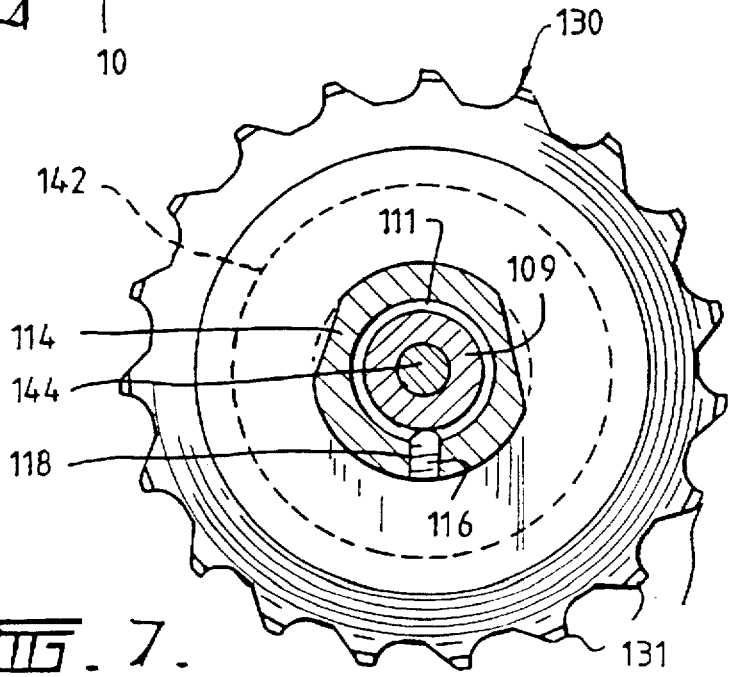
FIG. 7 is a longitudinal cross-sectional view along the lines 7—7 of FIG. 6.
Figure 8:
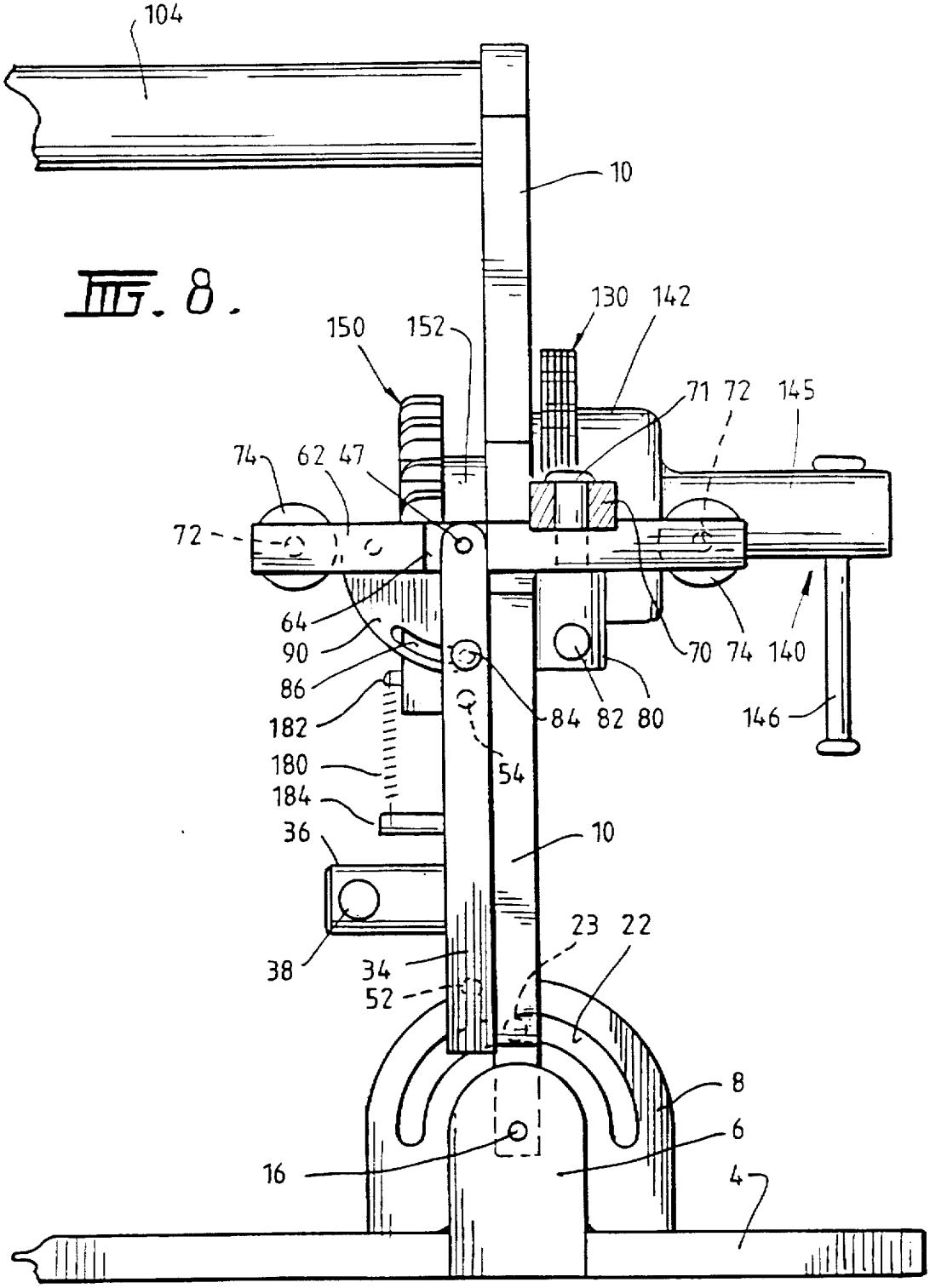
FIG. 8 is a longitudinal cross-sectional view taken along the line 8—8 of FIG. 3.

One modification of the device of the present invention involves guide 70. With particular reference to FIGS. 1, 2 and 4 it can be seen that guide 70 is provided with two opposed rounded ends. Each rounded end is composed to two differently curved profiles as can be most easily identified in FIG. 4. Thus, in all guide 70 is provided with four curved portions of different radii and guide 70 may be mounted to roller blade 60 in four different ways such that the radius of curvature presented by round portion 69 of guide 70 in FIG. 2 can be any one of the four curved end portions of guide 70. Guide 70 is provided with the different curved end portions to selectively position or orientate blade 70 with respect to file 75 depending upon the angle of cut to be imparted to each tooth 131 of the rotary blade 130. If a more curved profile is to be imparted to tooth 131, the more rounded profiles of guide 70 are arranged to engage with the gullets of the teeth, but if a less curved profile is to be imparted, the less rounded profiles of the ends of guide 70 are arranged to contact the gullets of the teeth of the rotary blade.

Figure 12:
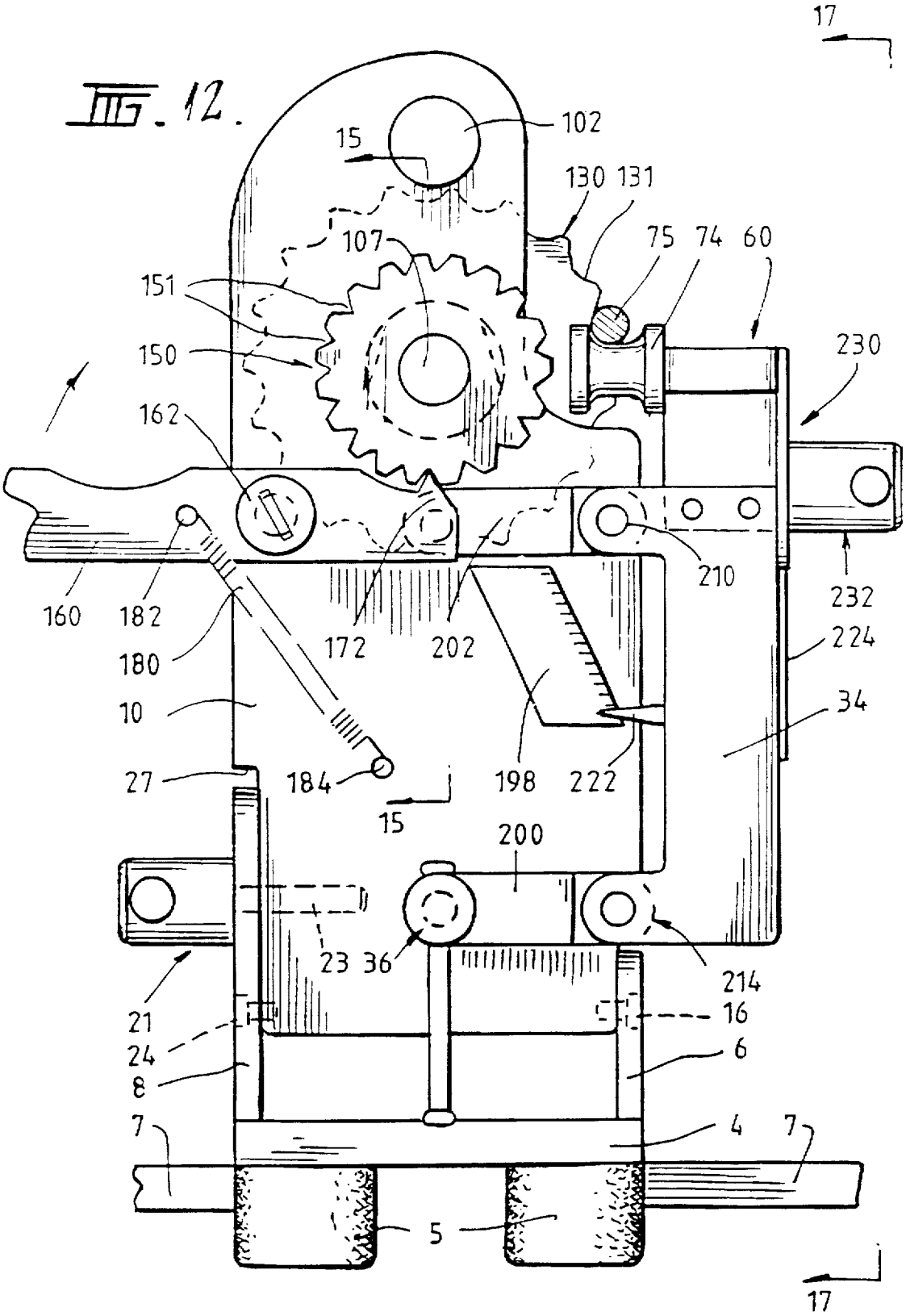
FIG. 12 is a front end elevational view of the device of FIG. 10 in one configuration for sharpening a rotary blade.
Figure 13:
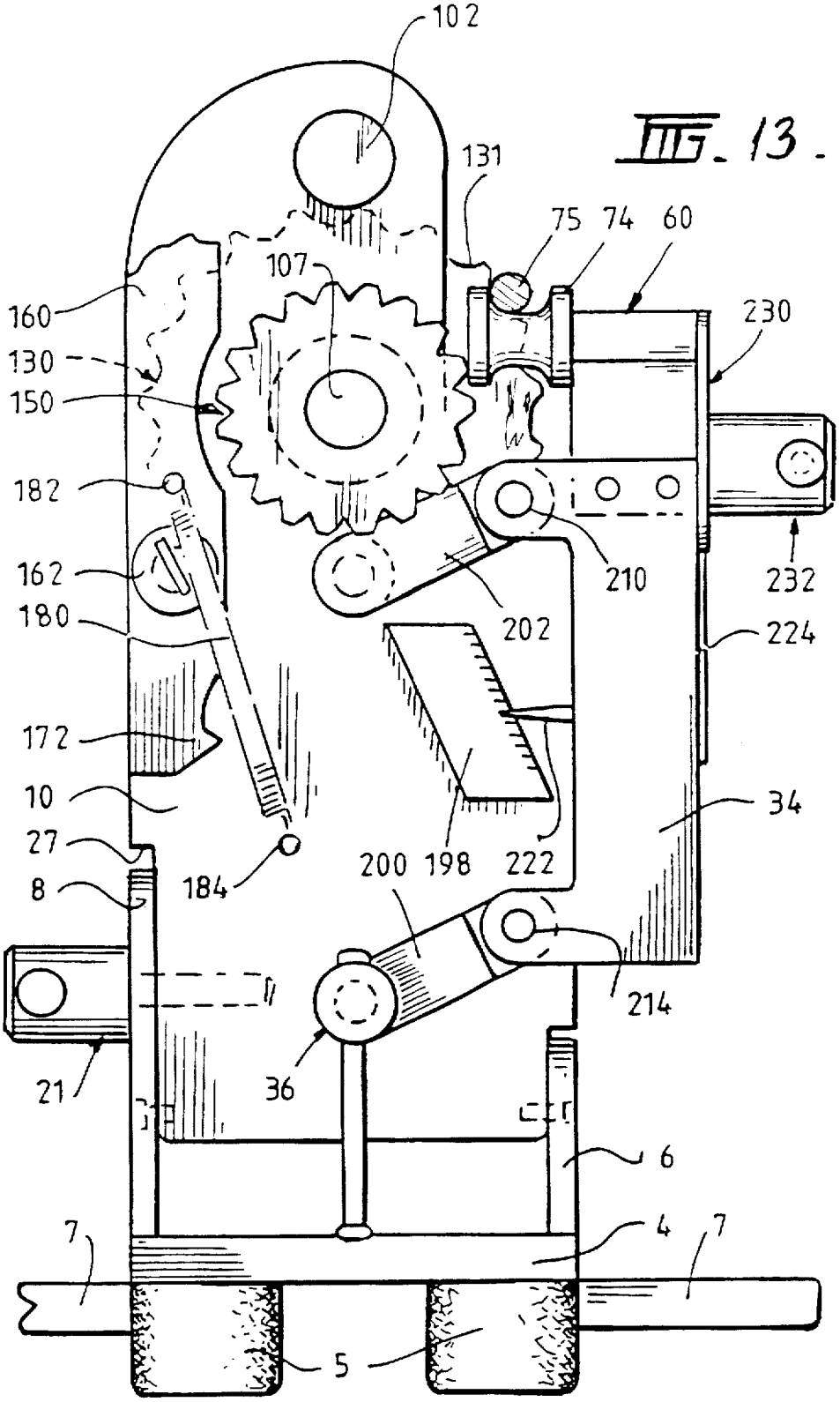
FIG. 13 is a view similar to that of FIG. 12 but in which the device adopts a different position.
Figure 14:
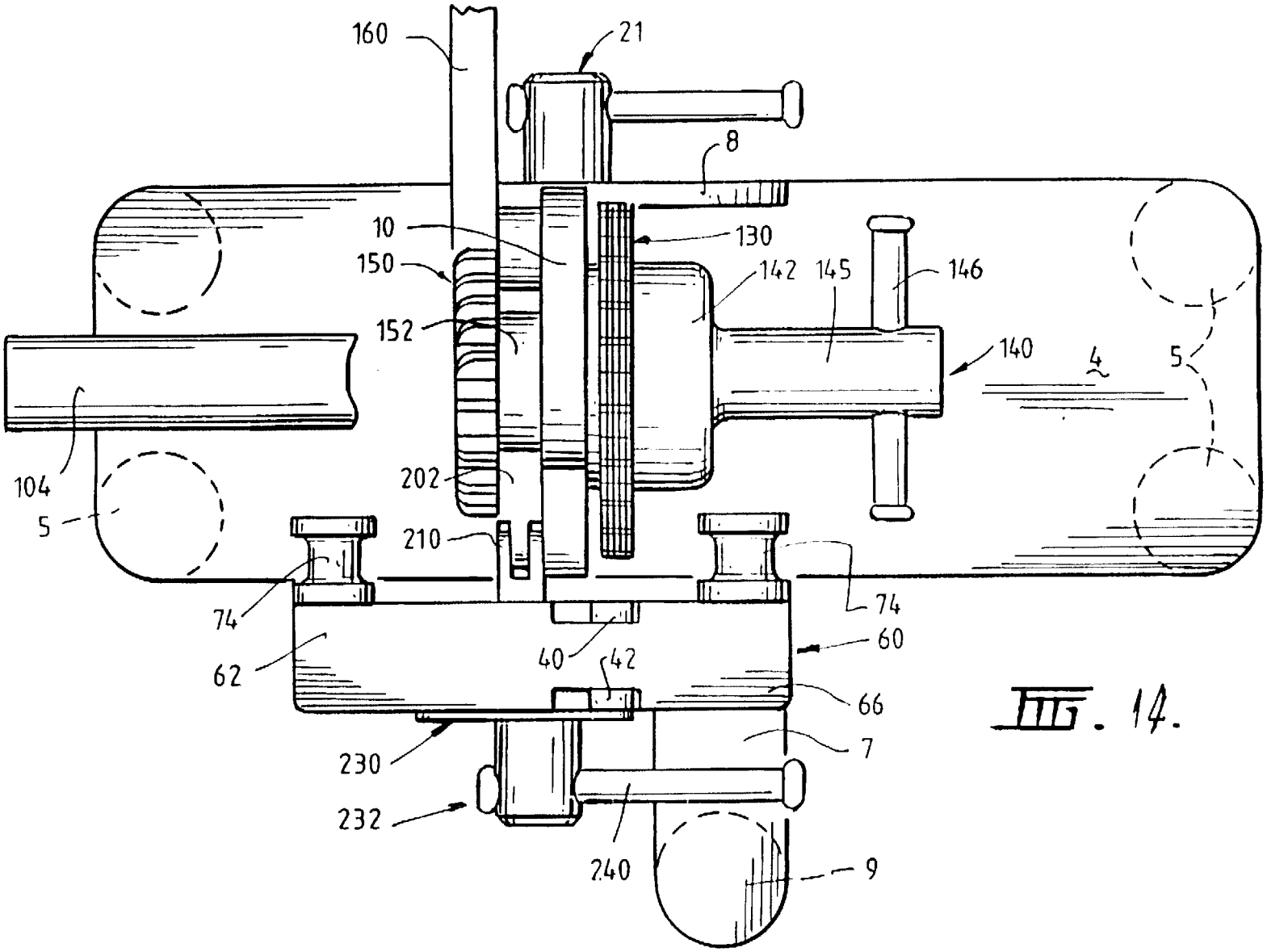
FIG. 14 is a top plan view of the device of FIG. 10.
Figure 15:
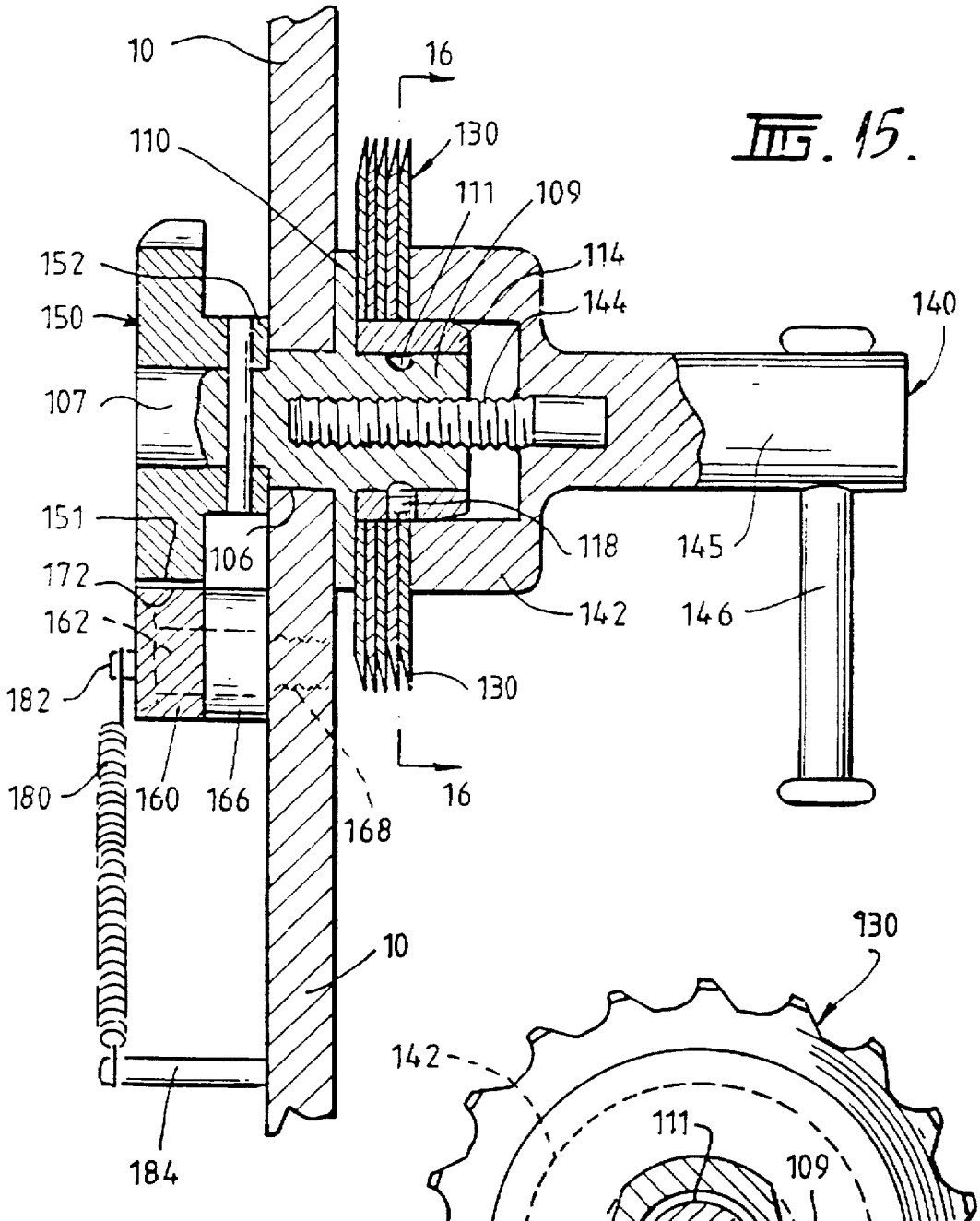
FIG. 15 is a longitudinal cross-sectional view along the line 15—15 of FIG. 12.
Figure 16:
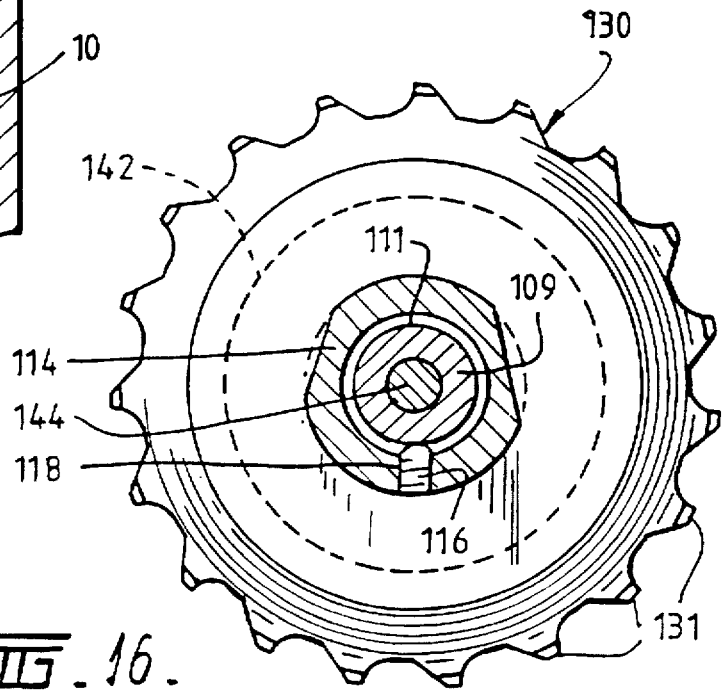
FIG. 16 is a transverse cross-sectional view along the lines 16—16 of FIG. 16.
Figure 17:
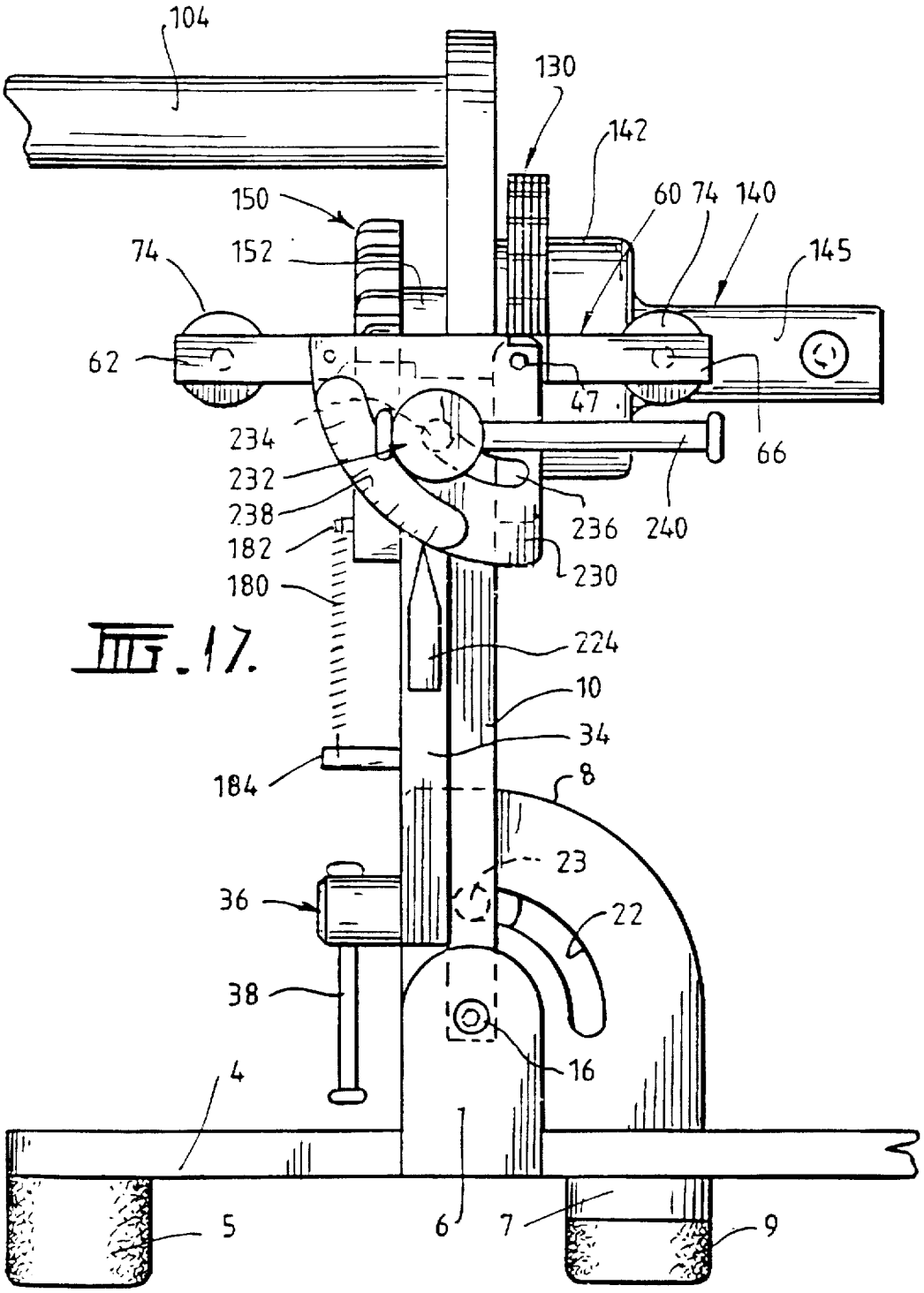
FIG. 17 is a side elevational view along the line 17—17 of FIG. 12.

Another form of the device of the present invention will now be described with reference to FIGS. 11 to 18 and in particular with reference to FIG. 12 which shows the component parts of this form of the device in an exploded view. It is to be noted that the use of relative terms such as up, down, inboard, upper and the like in the present specification to described embodiments of the invention is with respect to the normal in use position of the device of the present invention, such as that shown in the drawings.

Figure 18:
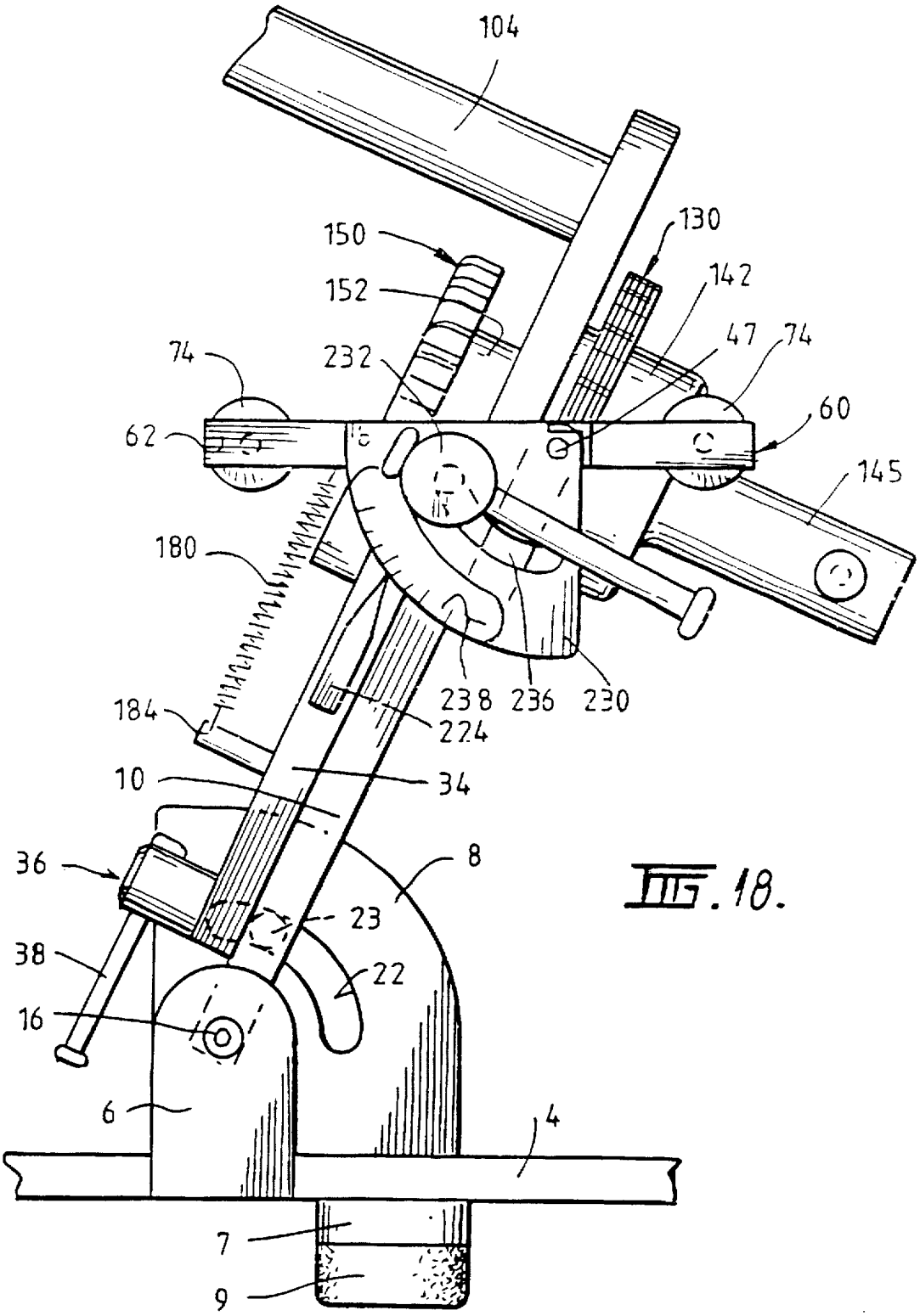
FIG. 18 is a side elevational view of a device of FIG. 10 shown in a further configuration.

In FIGS. 10 to 18 there is shown another form of the sharpening device of the present invention. Like reference numerals will be used in the following description to refer to similar features to those disclosed in FIGS. 1 to 9. However, new reference numerals will be used to refer to newly introduced features. Device 2 in essence comprises a substantially planar rectilinear base plate 4 from which a pair of hinge brackets 6, 8 extend upwardly for mounting a substantially planar back plate 10 which is pivotally moveable with respect to the base plate 4 by virtue of being hinged thereto by hinge brackets 6, 8. With particular reference to FIG. 18 back plate 10 is free to adopt a number of different angularly inclinable positions relative to base plate 4 to assist in sharpening blades using the device 2 which will be described in more detail later. In one extreme position, back plate 10 can be folded flat against base plate 4 so that both are substantially parallel for transport and/or storage. It is to be noted that back plate 10 can adopt any angle of inclination from 0° to 180° to base plate 4, with particular reference to FIG. 11 it can be seen that base plate 4 is substantially rectilinear and is provided with four support feet 5, one at each corner, for supporting device 2 on a suitable solid substrate if desired, and a air of outriggers or stabilisers 7 pivotally extending from either side of base plate 4. Stabilisers 7 are provided with feet 9 to assist in supporting the device on a solid substrate. Base plate 4 is also provided on either longitudinal side with a pair of opposed cut outs located towards one end from the mid point. Hinge brackets 6, 8 are received in the pair of opposed cut outs. Hinge bracket 6 which is in essence a pivot hinge bracket is substantially elongate having a semi-circular end provided with an aperture 14 therethrough. A pivot pin 16 having a threaded end is received through aperture 14 and is secured to back plate 10 by being received in a correspondingly threaded bore 18 provided in the rebate 17 at one lower corner in use of back plate 10. Bore 18 and rebate 17 are located in one side edge of plate 10.

Hinge bracket 8 functions as both a hinge and a lock and is therefore a locking hinge bracket. Bracket 8 is substantially wider than hinge hinge bracket 6 and is substantially longer than hinge bracket 6 as well as being provided with an aperture 20 for pivoting main plate 10 with respect to base plate 4 and a substantially semi-circular groove or slot 22 permitting adjustment of the position of back plate 10 with respect to base plate 4. A pivot pin 24 having a threaded end is received through aperture 20 and is threadingly engaged within threaded bore 31 provided in rebate 27 at the opposed lower in use corner from rebate 17 of back plate 10. An adjustment means in the form of a winged nut or lock screw 21 having an axial shaft 23 and a transverse handle 25 in the form of a dowel, rod or similar to enable rotation of lock screw 21 is arranged so that axial shaft 22 is received through semi-circular slot 22 into a further threaded bore 29 of back plate 10 spaced apart from threaded bore 31. Lock screw 21 can be loosened to allow for pivotal movement of back plate 10 with respect to base plate 4 in order to adjust the configuration or orientation of the device 2. When device 2 is in the desired or selected position lock screw 21 can be tightened to maintain the position of back plate 10 with respect to base plate 4. The position of back plate 10 can be altered with respect to base plate 4 from extending substantially perpendicularly therefrom in one extreme position to lie almost parallel in another extreme position or to any position in between. In the almost parallel position, device 2 can be transported and/or stored.

Back plate 10 carries a number of separate subassemblies as well as separate components. One component is a generally parallelogram shaped graduated scale 198 firmly fixed in place to back plate 10. On such subassembly will now be described. This subassembly allows adjustment for cutting the teeth of the rotary blade as will be described in more detail below.

This subassembly comprises adjustment plate 34 and a pair of parallel links 200, 202. Parallel link 200 is connected to back plate 10 by means of a threaded lock screw 36 having an axial shaft 37 and a transverse handle 38 in the form of a tommy bar or similar. The other parallel link 202 is connected to base plate 10 by screw 204. The other ends of each parallel link 200, 202 is connected to the lower and upper inboard sides of adjustment plate 34. Adjustment plate 34 is provided with an in use upper connecting portion 206 of two spaced apart arms 208, 210 defining a gap therebetween to form a yoke arrangement for receiving a complementary shaped connecting portion 212 or parallel link 202. The lower end in use of adjustment place 34 is provided with a lower connecting portion 214 of two spaced apart arms 216, 218 defining a space therebetween to form a yoke arrangement for receiving a complementary shaped connecting portion 220 or parallel link 200. A pointer in the form of a finger 222 or similar is provided to extend from the inboard side of adjustment plate 34 intermediate upper and lower connecting portions 206, 214 to cooperate with graduated scale 198 to provide a reference point for the position of adjustment plate 34. A second pointer or marker 224 is provided on the outboard edge of adjustment plate 34 which will be described in more detail below. Adjustment plate 34 is provided at its upper end in use with a generally right angled bracket arrangement in the form of a yoke arrangement defined by a pair of spaced apart upwardly extending arms 40, 42. Each arm has a rounded free end and is provided with an aperture 41, 43 respectively therethrough. The two apertures 41, 43 are in register with each other.

In use when lock screw is loosened from back plate 10 adjustment plate 34 can be moved vertically and horizontally by means of the two parallel links 200, 202 pivoting about axial shaft 37 and screw 204 to adjust the position of plate 34 in accordance with the desired position as indicated by pointer 222 with respect to graduate scale 198. When the adjustment plate 34 is in the selected position lock screw 36 is tightened to back plate 10 in order to retain adjustment plate 34 securely in position. Thus, adjustment plate 34 allows both vertical and horizontal adjustment of the device.

Another subassembly will now be described. Roller block 60 is pivotally connected to the upper end in use of adjustment plate 34 and is received in the yoke defined between arms 40, 42 of adjustment plate 34. Pin 47 is received through the aligned apertures 41, 43 provided in the ends of arms 40, 42 and through a bore 61 provided in the body of roller block 60 about its mid point. Roller block 60 has a head portion 62 located at one end and a body portion 66 located at the other end with a neck portion 64 located intermediate the head portion 62 and the body portion 66. Body portion 66 and head portion 62 of roller block 60 are each provided with a threaded bore for receiving the threaded ends of threaded pins 72 which form axles for rotating guide rollers 74 allowing guide rollers 74 to freely rotate about pins 72. Guide rollers 74 are each in the form of a double ended flange having a recessed central portion between the flanges in which the wall of the central portion between the flanges is substantially concavely cured. The shape or profile of the central portion of rollers 74 is adapted to receive a circular file (not shown) for sharpening the teeth of rotary blades mounted on the device which will be described in more detail later.

A substantially quadrant shaped graduated scale plate 230 is attached to the outboard side of roller block 60 by an adjustable locating screw 232. Quadrant plate 230 is fixed to roller block 60 by a pin 47 and comprises a semi-circular elongate curved slot 236 and a graduated semi-circular scale 238. Adjustable locking screw 232 comprises a threaded shaft 234 received through the semi-circular elongate slot 236 and a handle 240 for rotating screw 232.

Quadrant plate 230 is fixedly attached to roller block 60 at two spaced apart locations on the outboard facing edge of roller block 60 at the neck portion 64 and head portion 62. The first location is by means of pivot pin 47 which is received through apertures 41, 43 of arms 40, 42 of adjustment plate 34 and bore 61 of neck portion 64 of roller block 60 whereas the second location is in head portion 62 of roller block 60. Quadrant plate 230 when lock screw 240 is loosened allows roller block 60 to pivot about pi 47 with respect to adjustment plate 34. Thus roller block 60 is pivotally adjustable about a horizontal axis with respect to adjustment plate 34. Lock screw 240 is tightened to maintain roller block 60 in the desired position with respect to adjustment plate 34. Marker 224 on the outboard side of adjustment plate 34 cooperates with scale 238 of quadrant plate 230 to provide an indication of when roller block 60 is in the desired position with respect to adjustment plate 34. Thus, roller block 60 allows for angular inclination adjustment of the device of the present invention.

Returning to back plate 10, it can be seen that back plate 10 is provided with a threaded aperture 102 at the extreme upper end in use. Threaded rod 104 is threadingly received in aperture 102 to act as a carrying handle for device 2 when not in use. A similar threaded aperture 103 is provided in base plate 4 for receiving the end of threaded rod 104 so that rod 104 may be used to securely hold device 2 in place when device 2 is in use such as by rod 104 being received in a suitable holding means such as for example a vice or similar or being received in a bore of a stand or similar. In this configuration rod 104 extends downwardly in the opposite direction to the direction of extension of main plate 10. An additional aperture 103*a* is provided for the same purpose as aperture 103 at the other end of base plate 4 for flexibility in securing the device in places.

A second aperture 106 is provided at a location vertically spaced apart and below from aperture 102 for receiving a blade retaining subassembly for allowing individual blades being sharpened to be rotated in turn. The sub-assembly comprises blade spindle 108 which is received through aperture 106. Blade spindle 108 comprises a shaft having a reduced diameter shank portion 107 at one end for being received through aperture 106 and an internally threaded hollow portion 109 at the other end of a greater diameter than that of reduced diameter portion 107. Ratchet wheel 150 (to be described later) is received on portion 107 on the other side of main plate 10 as portion 107 extends through and beyond main plate 10.

A flange 110 is provided around and connected to the outside diameter of hollow portion 109. Flange 110 in use abuts against the side of main plate 10 opposite to that of ratchet wheel 150. Hollow portion 109 is provided with a circumferential groove 111 around the external circumference for receiving a suitable fastening means of a blade locating hub or collar 114.

Blade locating hub 114 is in the form of a substantially annular collar having an internal cylindrical bore and an outer profile in the form of a substantially irregular pentagon. In one embodiment blade locating hub 114 is provided with an aperture 116 in the side wall extending through the thickness of the side wall of collar 114 for receiving a grub screw 118 or similar which engages in groove 111 provided externally around the outside of portion 109 of blade spindle 108. The cylindrical bore of collar 114 is received over the outer circumference or hollow portion 109.

Rotary blade 130 having a plurality of cutting teeth 131 located at regularly spaced apart locations around the circumference of the blade is provided with a substantially irregular pentagonal eccentric cut out 132 of corresponding shape to the eccentric shape of the outer surface of blade locating hub 114 so that blade 130 may be placed over blade locating hub 114 in a single orientation only so as to hold blade 130 in the correct orientation when being sharpened.

An adjustable blade locking cap 140 is provided at one end with an annular cap portion 142 surrounding a centrally located threaded shaft 144 which extends longitudinally outwardly from the end of annular cap portion 142 and a main shaft 145 axially in alignment with threaded shaft 144. Main shaft 145 is provided with a tommy bar 146 or similar to facilitate rotation of the blade locking cap and in turn of rotary blade 130 so that each tooth 131 of blade 130 may be sharpened in turn. Threaded portion 144 of blade locking cap 140 is received through the cylindrical bore of blade locating hub 114 and is threadingly received in the internally threaded bore of portion 109 of blade spindle 108. When end cap 140 is securely fastened to spindle 108 rotary blade 130 is securely held in place so that the teeth 131 can be sharpened.

Returning now to the other end of the sub-assembly containing the blade locating hub 108 it can be seen that ratchet wheel 150 is received on the free end of reduced diameter shank portion 107 when it extends through aperture 106. Ratchet wheel 150 is provided with a spacer collar or boss 152 which in turn is provided with an axial bore and a radial aperture through which a suitable fastener can be received to attach ratchet wheel 150 to shank portion 107. Reduced diameter shank portion 107 is also provided with a radial aperture or bore 105. The suitable fastener is received through the radial aperture 105 when aligned with the radial bore of boss 152 to attach ratchet wheel 150 to blade spindle 108.

Release handle 160 is pivotally connected to back plate 10 by means of handle pi 162 being received through aperture 164 of handle 160 through spacer 166 located between handle 160 and back plate 10 and being received in threaded aperture 168 of back plate 10 at a position which is obliquely inclined to the position of aperture 106 on back plate 10. Release handle 160 is provided with a pawl arrangement 170 located at or towards one end thereof. Pawl arrangement 170 comprises a tooth 172 of complimentary shape to the grooves between adjacent teeth of ratchet wheel 150 so that pawl tooth 172 can engage with ratchet wheel 150. When pawl 170 is in engagement with ratchet wheel 150, ratchet wheel 150 is prevented from rotation which in turn prevents blade 130 from turning. When release handle 160 is moved to disengage pawl 170 from ratchet wheel 150, ratchet wheel 150 is free to rotate so that by an operator turning handle 146 the whole sub-assembly containing blade 130 may be turned. Alternatively, the teeth of the ratchet wheel 150 may be so shaped to allow ratchet wheel 150 to be turned in one direction only and be retained in place or the tooth 172 of pawl 170 is so shaped to allow rotation of wheel 150 in one direction only and prevent rotation in the other direction.

An arrangement bias is applied to release handle 160 by means of extension spring 180 extending between pin 182 securely attached to handle 160 and pin 184 securely attached to back plate pin.

Figure 19:
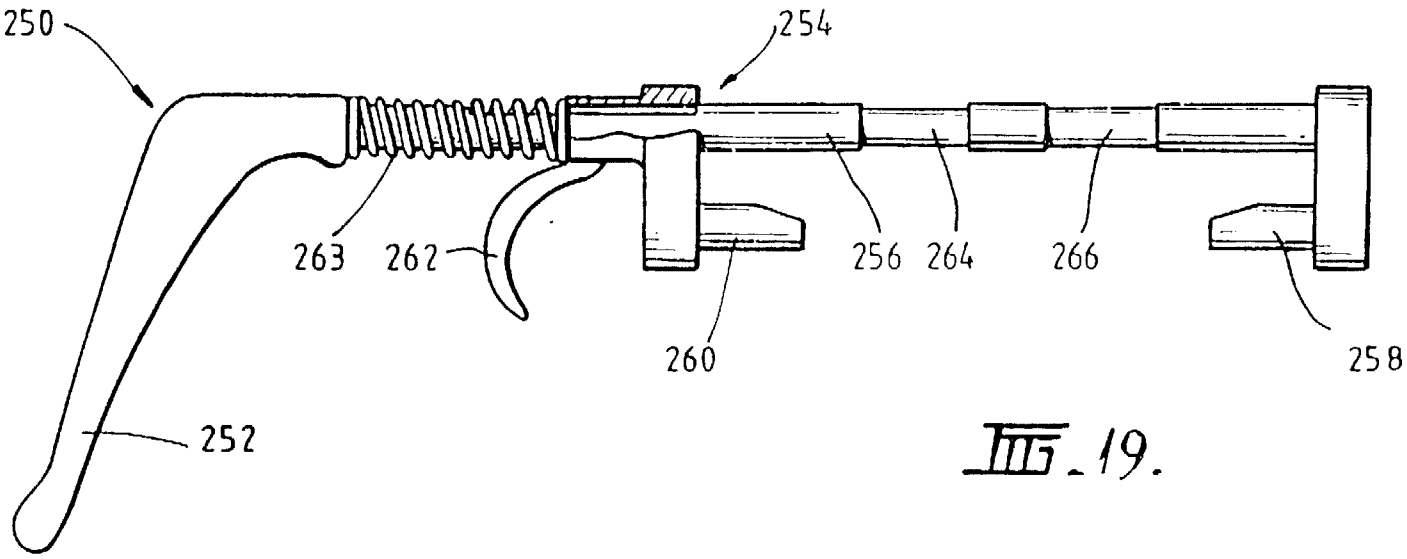
FIG. 19 is a side view of one form of the guide of the device of the present invention.
Figure 20:
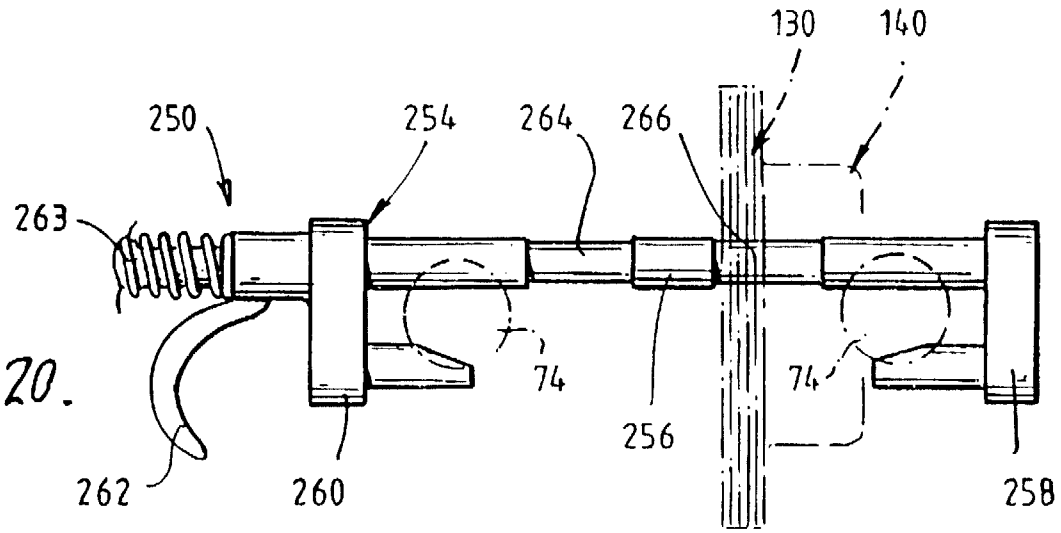
FIG. 20 is an in use side view of the guide of FIG. 19.

Guide 250 will now be described with particular reference to FIGS. 19 and 20. Guide 250 is for correctly aligning the individual blades on the blade retaining device in preparation of sharpening the teeth of the blade. Guide 250 is removed from the device after the blades have been accurately located and prior to sharpening of the teeth. Guide 250 is a feature which is equivalent to guide 70 of the embodiment of FIGS. 1 to 9 and serves the same purpose to align the individual blades 130 in the correct position so that they may be sharpened by file 75.

Guide 250 comprises grip 252 in the form of a pistol like grip or stock and a body 254 in the form of a substantially cylindrical rod 256. A fixed hook arrangement comprising a substantially U-shaped member 258 is provided at or towards the end of rod 256 opposite to that of grip 252. A slideably moveable hook arrangement 260 in the form of a substantially U-shaped member and collar is provided on rod 256 intermediate the pistol grip 252 and fixed hook 258 and is slideably moveable along rod 256. A finger operated releasable trigger 262 is associated with moveable hook arrangement 260. Trigger 262 is operable between a locked condition in which hook 260 is prevented from movement and a release condition in which hook 260 is free to slide along rod 256. A compression spring 263 is located intermediate the outboard facing end of moveable hook arrangement 260 and pistol grip 252. Spring 263 provides a bias for moveable hook 260 to urge it towards fixed hook 258. The two hooks 260, 258 are adapted to co-operate with roller 74. In use, trigger 262 is released allowing hook 260 to be withdrawn towards grip 252. Hook 258 is placed over one of rollers 74 and hooked thereonto while hook 260 still in the withdrawn position is placed over the other of rollers 74 and trigger 262 released thus allowing hook 260 to hook around the roller and be retained there. Thus, guide 250 can be located on device 2.

Rod 256 is provided with two guide portions 264, 266 depending on the depth of cut required of the individual teeth 131 of blade 130. Guide portions 264, 266 are reduced diameter portions as compared to the normal diameter of rod 256. In use guide 250 is located on rollers 74 to assist in accurately locating blades 130 on device 2 in preparation of sharpening the teeth of the blades, as shown in FIG. 20. One set of gullets between adjacent teeth 131 of blades 130 is located against one of guide portions 264 or 266 depending on the depth of cut and angle of cut required to sharpen the blades 130.

In use of the device 2 of the present invention, base plate 4 is located on a suitable supporting substrate, such as for example, on a bench, stand or similar. Typically, device 2 may be permanently mounted on a bench or suitable stand such as by releasable fasteners or screws or the like, or handle 104 may be removed from aperture 102 and threadingly inserted in a suitable threaded aperture 103 or **103*a* provided in the base plate 4 to extend downwardly. Handle 104** may then be clamped or otherwise fastened to a suitable solid support, such as in the vice or similar.

Once device 2 is securely held in place, lock screw 21 is loosened and the position of back plate 10 is adjusted with respect to base plate 4. Once back plate 10 is in the correct position lock screw 21 is tightened so as to securely maintain back plate 10 in the correct position.

End cap 140 is then removed from blade spindle 108 by being rotated which threadingly disengages threaded shaft 144 from the threaded bore of hollow portion 109. One or more blades 130 are then placed upon blade locating hub 114 by irregular pentagonal cut out 132 being received over complementary shaped blade locating hub 114.

In the case of the embodiment shown in FIGS. 10 to 19, each of the blades 130 received on blade locating hub 114 is approximately aligned and then correctly oriented by one gullet between adjacent teeth of each blade being located against either guide portion 264 or 266 of guide 250. Then blade locking cap 140 is partially tightened by being rotated so that shaft 144 is received in hollow portion 109.

Then, lock screw 36 is loosened which allows adjustment plate 34 to move about parallel links 200, 202 and be positioned at the correct height and width. When adjustment plate 34 is in the correct position, lock screw 36 is tightened to maintain the position of adjustment plate 34. Thus, the vertical and horizontal position of adjustment plate 34 is adjusted.

Finally, lock screw 232 is loosened which allows roller block 60 to be pivoted to adopt the desired position. Roller block 60 is pivotable by the action of quadrant plate 230 moving with roller block 60 wherein the shaft 234 of lock screw 232 is received through arcuate slot 236.

When roller block 60 is in the correct position, lock screw 232 is tightened. In one preferred position, roller block 60 is adjusted to lie in the same plane as base plate 4 i.e. both roller block 60 and base plate 4 are in the same substantially parallel relationship or nearly so.

Now that device 2 is fully adjusted and guide 250 removed from rollers 74, circular file 75 is placed upon rollers 74 so that the body of the file is received in the curve sided central portion of each roller. When in this position the outer surface of file 75 contacts the cutting surface of the tooth of each blade 130 located nearby. Axial movement of file 75 backwards and forwards allows each set of teeth of the collection of blades to be sharpened.

When the first set of teeth are sharpened, release handle 160 is moved against the spring bias of spring 180 so that pawl 172 disengages from ratchet wheel 150 thus allowing ratchet wheel 150 to turn. By rotating end cap 140, the next step of adjacent teeth of blades 130 is positioned ready to be sharpened and release handle 160 is then released which allows pawl 172 to engage with ratchet wheel 150. The next set of teeth are sharpened and so on until all of the teeth of all of the blades are sharpened. Alternatively, end cap 140 may be rotated against the bias of spring 180 holding pawl 172 of ratchet wheel 150 by having the teeth of ratchet wheel 150 so shaped to allow ratchet wheel 150 to slide past pawl 172, and click into place against the next tooth of ratchet wheel 150.

The described arrangement has been advanced by explanation and many modifications may be made without departing from the spirit and scope of the invention which includes every novel feature and novel combination of features hereindisclosed.

Those skilled in the art will appreciate that the invention described herein is susceptible to variations and modifications other than those specifically described. It is understood that the invention includes all such variations and modifications which fall within the spirit and scope.

The advantages of the present invention include the following:

- The sharpening device is portable enabling it to be easily transported from one shearing shed to another.
- The sharpening device is fully adjustable enabling the cutting edge of each individual tooth to be profiled exactly to satisfy the demands of any given situation such as dirty or dusty wool, different breeds of sheep, different climatic conditions and the like, or for use with animals other than sheep, or in any industrial situation for cutting a wide variety of materials.
- More than a single blade may be sharpened at a time.
- Each tooth or gullet between adjacent teeth is accurately positioned once the blade has been set up as each tooth is rotated into the correct position upon rotation of the subassembly holding the blades.

The device may be collapsed by folding the back plate flat against the base plate which makes it easier to transport and store the device.

Thus, the device of the present invention allows blades to be sharpened quickly and easily, particularly as many blades may be sharpened simultaneously, which reduces the downtime or unproductive time during the working day of the shearer or requires less time after normal working hours leaving more free time for the shearer.

I claim:

1. A device for sharpening a cutting edge of a cutting element, said device comprising a base member for supporting the device in use, a main member pivotably moveable with respect to the base member, said main member having a retaining subassembly for selectively holding the cutting element in a desired position, said retaining subassembly being moveable with respect to the main member, and a guide subassembly connected to or mounted on the main member, said guide subassembly being selectively moveable with respect to the main member to adopt a desired position, said guide subassembly being provided with a guide member for guiding movement of a sharpening means in use to sharpen the cutting element held by the retaining means, wherein said device is arranged in use to allow selective sharpening of the cutting element after adjustment of the positions of the guide subassembly and retaining subassembly with respect to the main member and after adjustment of the position of the main member with respect to the base member.

2. A device for sharpening a cutting edge of a cutting element, said device comprising a base member for supporting the device in use, a main member pivotably moveable to the base member and extending substantially transversely from the base member, said main member being selectively adjustable with respect to the base member, said main member being provided with a guiding subassembly for guiding the movement of a sharpening means with respect to the cutting element, said guiding subassembly being pivotally moveable with respect to the main member and being arranged to extend substantially transversely with respect to the main member, said guiding subassembly comprising guide means for interacting with the cutting element and roller means for cooperating with the sharpening means by allowing movement of the sharpening means along a predetermined path with respect to the cutting element, and said main member being provided with a retaining subassembly for retaining the cutting element in a predetermined position with respect to the main member, said retaining subassembly being rotatable with respect to the main member to present different portions of the cutting edge of the cutting element to be sharpened wherein said guide means engages the cutting element to selectively adjust the position of the cutting element with respect to the guiding subassembly thereby allowing selective sharpening of the cutting edge or similar of a portion of the cutting element by movement of the sharpening means with respect to the cutting element, and then by rotation of the retaining subassembly a further portion of the cutting edge is presented for sharpening.

3. A device for sharpening a cutting edge of a cutting element of a cutting machine, said device comprising a substantially rectilinear planar base plate to which a substantially planar main plate is pivotally connected to extend substantially transversely thereto and being able to adopt a selective position thereto, said base plate for supporting the device in use, said main plate being provided with an adjustment plate which is obliquely inclinedly moveable with respect to the main plate, said adjustment plate being selectively positionable with respect to the main plate, said adjustment plate being provided with a guiding subassembly comprising a substantially transversely movable guide means and a pair of spaced apart roller wheels, said roller wheels being arranged for guiding the movement of a sharpening means and the guide means being provided for engaging a portion of the cutting element to selectively position the cutting element with respect to the sharpening means such that movement of the sharpening means selectively sharpens the portion of the cutting element contacted by the sharpening means, said main member being further provided with a holding subassembly extending transversely from the main plate and being rotatable thereto, said holding subassembly comprising a cutting element holding portion which upon rotation presents different portions of the cutting element in turn to the sharpening means for sharpening thereby.

4. A device as claimed in claim 1 wherein the cutting element is a cutting blade.

5. A device as claimed in claim 1 in which the cutting element comprises a rotary blade which is provided with a plurality of teeth regularly spaced around the circumference of the blade.

6. A device as claimed in claim 5 wherein a plurality of rotary blades may be sharpened simultaneously within the device.

7. A device as claimed in claim 1 wherein the sharpening element is a file.

8. A device as claimed in claim 1 wherein the base member further comprises outriggers or stabilizers which are pivotably moveable to extend outboardly beyond the perimeter of the base member to provide additional support when the device is on a solid substrate.

9. A device as claimed in claim 8 wherein the base member or the outrigger/stabilizer is provided with feet members.

10. A device as claimed in claim 1 wherein the base member further comprises means for securely holding the base member during use of the device, comprising a handle member which may be selectively located at a number of different remote locations on either the base member or the main member.

11. A device as claimed in claim 1 wherein the main member is a substantially planar member which is movably mounted to the base member.

12. A device as claimed in claim 1 wherein the main member is pivotally mounted to the base member by a pair of spaced apart hinge brackets, one of the hinge brackets being a locking bracket or being provided with a releasably securable locking means.

13. A device as claimed in claim 12 wherein at least one of the hinged brackets is provided with means for selectively adjusting the position of the main member with respect to the base member and with releasably securable locking means for retaining the main member in the selectively adjustable position with respect to the base member.

14. A device as claimed in claim 1 in which the main member is pivotally moveable with respect to the base member from about 0° to 180° and is able to adopt a position with respect to the base member at any angle between 0° and 180° in use.

15. A device as claimed in claim 1 wherein the main member is provided with a number of subassemblies connected or mounted thereon.

16. A device as claimed in claim 1 wherein the main member is provided with a retaining subassembly for retaining the cutting element.

17. A device as claimed in claim 1 wherein the retaining subassembly is moveable with respect to the main member preferably rotatable with respect to the main member.

18. A device as claimed in claim 1 wherein the retaining subassembly is selectively rotatable with respect to the main member to adopt a number of different positions, the positions corresponding to the positions of the gullets between adjacent teeth, said positions allowing teeth of the rotary blade to be sharpened in turn.

19. A device as claimed in claim 1 wherein the retaining subassembly further comprises a toothed wheel for allowing selective rotary positioning of the rotary blade, wherein the spacing of the teeth of the toothed wheel corresponds to the spacing of the teeth on the rotary blade.

20. A device as claimed in claim 19 wherein the toothed wheel is associated with a releasably securable retaining means such as a pawl arrangement and a releasable handle for enabling selective positioning of the cutting element, said releasable handle being spring biased to enable contact between the tooth wheel and pawl arrangement to be maintained so as to prevent unwanted movement of the retaining subassembly in use.

21. A device as claimed in claim 1 wherein the retaining subassembly comprises a clamp arrangement for clamping one or more rotary blades together to enable rotary movement of the blades for sharpening of their teeth.

22. A device as claimed in claim 21 wherein the clamping arrangement comprises an adjustable blade locking end cap, a blade locating hub and a blade spindle wherein the blades are clamped between the lock cap and the blade spindle, and said locating hub being located between the blade spindle and the lock cap for carrying the blades and permitting rotation of the blades by said locating hub being received in apertures centrally located within the blades.

23. A device as claimed in claim 1 wherein the main member is provided with a guide subassembly, said guide subassembly being moveable with respect to the main member.

24. A device as claimed in claim 1 wherein the guide subassembly is pivotally moveable with respect to the main member so as to be selectively angularly inclined thereto, and to be angularly inclinable to the base member, including being able to be adjusted to assume a parallel relationship with the base member.

25. A device as claimed in claim 1 wherein the guide subassembly further comprises a pair of spaced apart rollers for guiding the sharpening element to sharpen the cutting surfaces of the cutting element.

26. A device as claimed in claim 1 wherein the guide subassembly is selectively adjustable with respect to the main member so as to vertically and horizontally adjust the guide subassembly.

27. A device as claimed in claim 1 wherein the guide subassembly is further provided with an adjustment plate allowing vertical and horizontal adjustment of the adjustment plate with respect to the main member.

28. A device as claimed in claim 27 wherein the adjustment plate is connected to the main member by a pair of spaced apart stepped blocks or a pair of spaced apart parallel links allowing adjustment of the adjustment plate allowing movement of the adjustment plate to the main member.

29. A device as claimed in claim 27 wherein the adjustment plate is provided with a marker or pointer to assist in selectively adjusting the position of the adjustment plate.

30. A device as claimed in claim 27 further comprising rollers, the rollers are carried by a roller block wherein said roller block is angularly inclinable to the adjustment plate and connected thereto so that movement of the roller block at least in part is effected by movement of the adjustment plate.

31. A device as claimed in claim 30 wherein the roller block is associated with a quadrant plate allowing selective adjustment of the roller block to the adjustment plate in accordance with a predetermined setting, said movement allowing the roller block to be angularly inclinable to the adjustment plate and to the main member.

32. A device as claimed in claim 30 wherein the roller block is provided with a releasably securable locking means to provide selective adjustment and to maintain the roller block in the selected position.

33. A device as claimed in claim 30 wherein the guide subassembly is associated with a guide, said guide for accurately positioning the blades in conjunction with the blade retaining subassembly to effect sharpening of the blades by movement of the sharpening element linearly along the rollers, said guide being locatable on the rollers for contact with the gullets between adjacent teeth on the blades.

34. A device as claimed in claim 33 wherein the guide subassembly is removed from the device or displaced from contact with the blades prior to sharpening of the blades.

* * * * *